US010544638B2

(12) United States Patent
Styler

(10) Patent No.: US 10,544,638 B2
(45) Date of Patent: Jan. 28, 2020

(54) DUAL DIRECTION J-SLOT TOOL

(71) Applicant: DRECO ENERGY SERVICES ULC, Calgary, Alberta (CA)

(72) Inventor: Graham Styler, Calgary (CA)

(73) Assignee: Dreco Energy Services ULC, Calgary (CA)

( * ) Notice: Subject to any disclaimer, the term of this patent is extended or adjusted under 35 U.S.C. 154(b) by 9 days.

(21) Appl. No.: 15/735,262

(22) PCT Filed: Jun. 10, 2016

(86) PCT No.: PCT/CA2016/050670
§ 371 (c)(1),
(2) Date: Dec. 11, 2017

(87) PCT Pub. No.: WO2016/197254
PCT Pub. Date: Dec. 15, 2016

(65) Prior Publication Data

US 2018/0163490 A1 Jun. 14, 2018

Related U.S. Application Data

(60) Provisional application No. 62/174,370, filed on Jun. 11, 2015.

(51) Int. Cl.
*E21B 23/00* (2006.01)
*E21B 34/14* (2006.01)
*E21B 43/26* (2006.01)

(52) U.S. Cl.
CPC ..... *E21B 23/006* (2013.01); *E21B 34/14* (2013.01); *E21B 43/26* (2013.01)

(58) Field of Classification Search
CPC ..... E21B 23/006; E21B 34/14
See application file for complete search history.

(56) References Cited

U.S. PATENT DOCUMENTS

| | | | |
|---|---|---|---|
| 6,782,954 | B2 | 8/2004 | Serafin et al. |
| 8,201,631 | B2 | 6/2012 | Stromquist et al. |
| 2015/0129197 | A1 | 5/2015 | Andreychuk et al. |

FOREIGN PATENT DOCUMENTS

| | | | |
|---|---|---|---|
| AU | 2010319759 | A1 | 5/2012 |
| RU | 2243357 | C2 | 12/2004 |
| RU | 60605 | U1 | 1/2007 |

OTHER PUBLICATIONS

International Patent Application No. PCT/CA2016/050670 International Search Report and Written Opinion dated Sep. 12, 2016 (7 pages).

(Continued)

*Primary Examiner* — Kristyn A Hall
(74) *Attorney, Agent, or Firm* — Corinna L. Joss

(57) ABSTRACT

A multi-position tool for use at a downhole end of a conveyance string for operation in a casing string is provided. The tool comprises a mandrel connected to the conveyance string; an actuation housing slidably shiftable axially along the mandrel between an uphole position, at least one intermediate position and a downhole position; an uphole device operable between an activated position when the actuation housing is in the uphole position, and a deactivated position; and a downhole device operable between an activated position when the actuation housing is in the downhole position, and a deactivated position. Both the uphole and downhole devices are in their deactivated positions when the actuation housing is in the at least one intermediate position. The tool has a J-slot mechanism operable between the actuator housing and the mandrel for shifting the actuator housing between the uphole, at least one intermediate, and downhole positions.

20 Claims, 26 Drawing Sheets

(56) References Cited

OTHER PUBLICATIONS

Russian Patent Application No. 2017143466 Decision to Grant a Patent for an Invention, Examination Report and Search Report dated Sep. 2, 2019 (27 pages).

DUAL DIRECTION J-SLOT TOOL

CROSS-REFERENCE TO RELATED APPLICATIONS

The present application is a National Phase entry of, and claims priority to, PCT Application No. PCT/CA2016/050670, filed Jun. 10, 2016, which claims the benefit of U.S. Provisional Application No. 62/174,370, filed Jun. 11, 2015, the entire contents of each being hereby incorporated by reference herein for all purposes.

STATEMENT REGARDING FEDERALLY SPONSORED RESEARCH OR DEVELOPMENT

Not applicable.

FIELD

Embodiments herein relate to a dual direction J-slot tool and more specifically, a dual direction J-slot tool useful for operating two devices independently downhole.

BACKGROUND

Oil and gas wells are often stimulated by fracturing or other treatments to enhance production. Wellbores, particularly long horizontal wellbores, are typically stimulated at a plurality of zones or stages. A completion string is fit with a plurality of completion valves spaced therealong. Some multi-zone fracturing shifting tools are used to open or close completion valves. This tool contains a set of shifting dogs that are held or biased outwardly by springs. The shifting dogs are profiled on a downhole face so as to pass down through the sleeve, repeatedly being ramped radially inwardly by the profile to pass narrow bore portions. When pulled back up through the sleeve, an uphole profile of the dogs will latch into a sleeve shifting profile, and pulling the dogs further up shifts the sleeve open.

As shown in FIGS. 1A and 1B, a prior art flow-shifting tool is configured to actuate the dogs D hydraulically by pumping fluid through the tool. The dogs are spring-biased to extend radially outwardly but are temporarily held radially inwardly by a retainer sleeve S so they cannot latch into any shifting profiles until fluid is pumped through the tool, shifting the sleeve and disengaging the dogs to enable extension thereof.

Currently, there are a number of different ways to complete a system in this manner. One way, as developed by the Applicant, is to run the flow-shifting tool of FIGS. 1A and 1B coupled to a J-slot resealable packer tool. Once the shifting tool has been used to open the completion valve the J-slot is shifted and the packer is set below the valve, isolating the open valve from any previously opened valves therebelow. After the treatment is completed, the J-slot is shifted, the packer is disengaged, and the flow-shifting tool is moved up to open the next valve.

As shown in FIG. 2, another way is to run two opposing shifting tools at the same time to provide two opposing shifting profiles $SP_1$, $SP_2$ in the frac valve sleeve. One shifting tool, having uphole catches, is used to open the valve to expose frac ports FP by pulling up. The frac is placed, and then the other opposing shifting tool, having downhole catches, is used to re-close that valve. With the open and close capability, valves are opened, fractured, and then closed as the tool moves up the well. Once all valves have been fractured, they are all re-opened to produce the well.

FIGS. 3 and 4 show a mechanical resealable packer commonly used in the frac tools, which is also called a J-slot packer. The packer has a packer element PE, a setting cone SC, casing slips CS, and drag blocks DB, all supported on a mandrel M. The packer element PE is set and reset by varying the position of a pin P riding in a revolving J-slot profile J that is machined into the mandrel. As the tool is cycled up and down in the well bore, the pin in the profile moves the tool from a "run-in-hole" position (i.e. with the packer element retracted) to a "pull-out-of-hole" position (i.e. with the packer element retracted), then to a "set" position (i.e. with the packer element set or expanded), and then back to a "pull-out-of-hole" position. The pin is in the "run-in-hole" (RIH) slot of the J-slot profile when the tool is in the run-in-hole position; the pin is in the "pull-out-of-hole" (POOH) slot of the J-slot profile when the tool is in the pull-out-of-hole position; and the pin is in the "set" (SET) slot of the J-slot profile when the tool is in the set position.

As shown in FIG. 4, the J-slot pattern for cycling the tool between the run-in-hole, pull-out-of-hole, and set positions spans the entire circumference of the mandrel so as to repeat about the circumference of the mandrel. The J-slot mechanism can be cycled to place the tool in a desired position. For example, occasionally sand can get in the J-slot and temporarily limit the pin's movement, or while running in hole the pin can skip over a slot, thereby placing the tool in a different position than intended. The tool can be placed in the desired position again by cycling through the slots in the J-slot profile.

Applicant contemplated mechanically activating a shifting tool in a similar manner. In addition to engaging casing slips to set the packer in the casing, a J-slot mechanism can also be used to expand and retract shifting dogs for shifting open a frac valve sleeve. The challenge in doing so is that the tool string would then have two separate J-slots working opposite and independently from one another. The two J-slots have to function such that when the packer J-slot is in the "set" position, the next pull up on the shifting J-slot would have to be in the shifting tool's "set" position (i.e. with the shifting dogs in an expanded position) to open the sleeve. However, if one of the two J-slots ends up jamming or skipping into the different position unintentionally, as described above, the two independent J-slots are then thrown out of sync and will not operate as expected. Depending on how the double J-slot tool is configured, both the packer and the dogs could be set and the tool could potentially be stuck in the well, thereby preventing the tool from moving up or down because the tool keeps "setting" in either direction.

SUMMARY

According to a broad aspect there is provided a multi-position tool at a downhole end of a conveyance string for operation in a casing string, the tool comprising: a mandrel connected to the conveyance string; an actuation housing slidably shiftable axially along the mandrel between an uphole position, at least one intermediate position and a downhole position; an uphole device operable between an activated position when the actuation housing is in the uphole position, and a deactivated position; and a downhole device operable between an activated position when the actuation housing is in the downhole position, and a deactivated position, wherein both the uphole and downhole devices are in their deactivated positions when the actuation housing is in the at least one intermediate position; and a J-slot mechanism operable between the actuator housing and the mandrel for shifting the actuator housing between the uphole, at least one intermediate, and downhole positions.

BRIEF DESCRIPTION OF THE DRAWINGS

The invention will now be described by way of an example embodiment with reference to the accompanying simplified, diagrammatic, scale drawings. In the drawings.

DETAILED DESCRIPTION OF THE PREFERRED EMBODIMENTS

When describing the present embodiments, all terms not defined herein have their common art-recognized meanings. To the extent that the following description describes a specific embodiment or a particular use, it is intended to be illustrative only. The description aims to cover all alternatives, modifications and equivalents. The scope of the claims should not be limited by the preferred embodiments set forth in the examples, but should be given the broadest interpretation consistent with the description as a whole.

As described herein, a dual direction J-slot tool is provided for reliably actuating two separate downhole operations. More specifically, the tool uses a single J-slot to perform two operations, which precludes a conflict. Such operations include, for example, opening multiple sliding sleeve frac valves for sequential fracing through each valve into a subterranean formation; expanding a packer; retracting a packer; and closing sliding sleeve frac valves. The two operations are performed asynchronously. The tool may be deployed by a single conveyance string such as a coiled tubing.

Figure 9A:
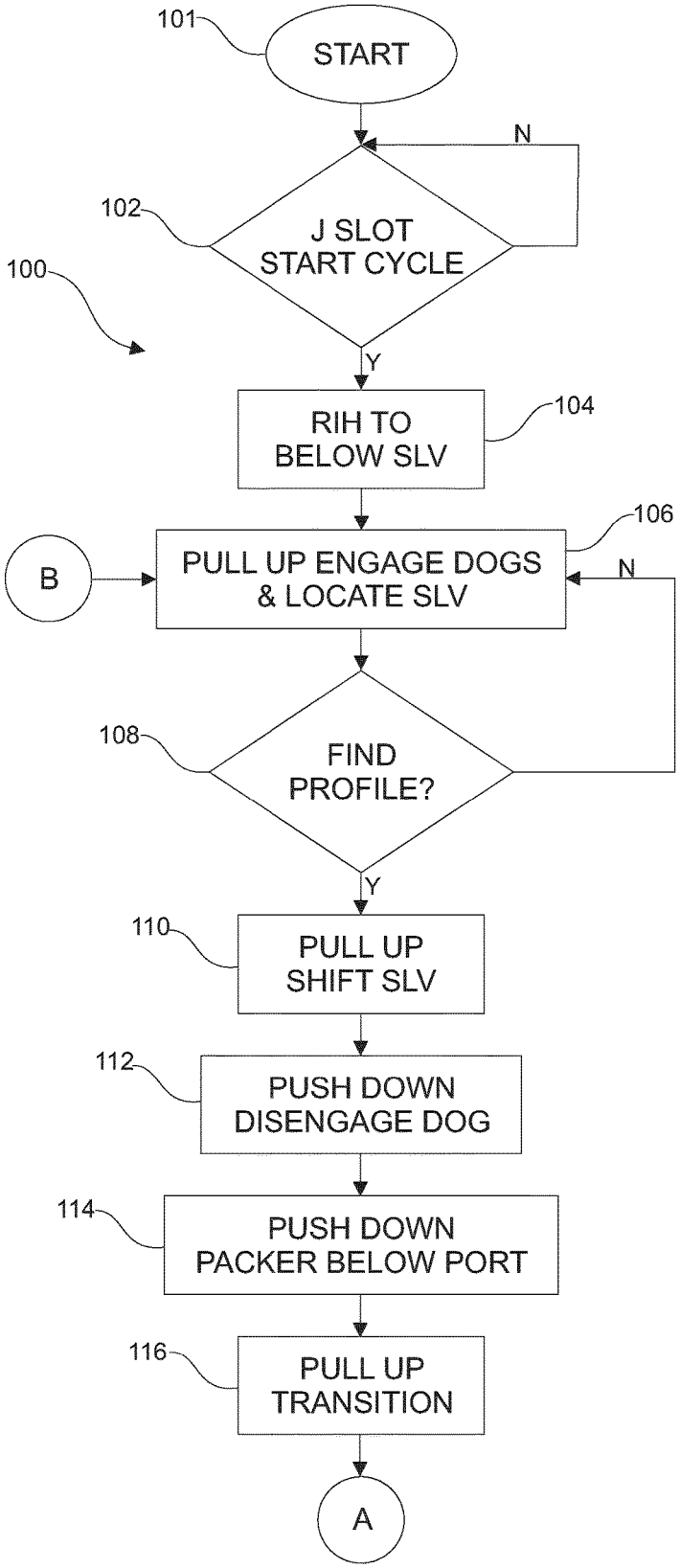
FIGS. 9A and 9B are a flowchart illustrating the sequence of events and the corresponding pin location in the J-slot profile when the dual direction J-slot tool is in operation.
Figure 9A:
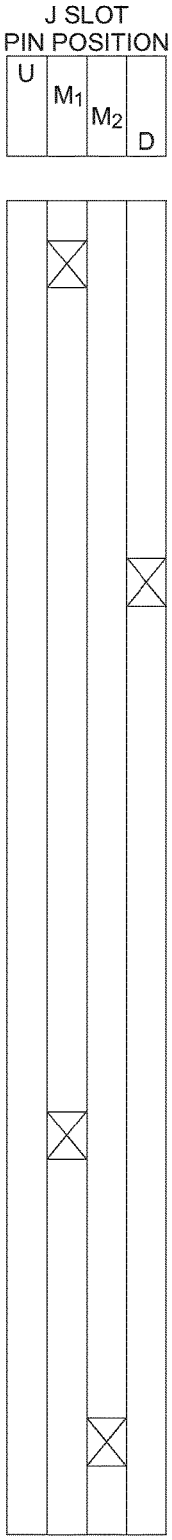
Figure 9B:
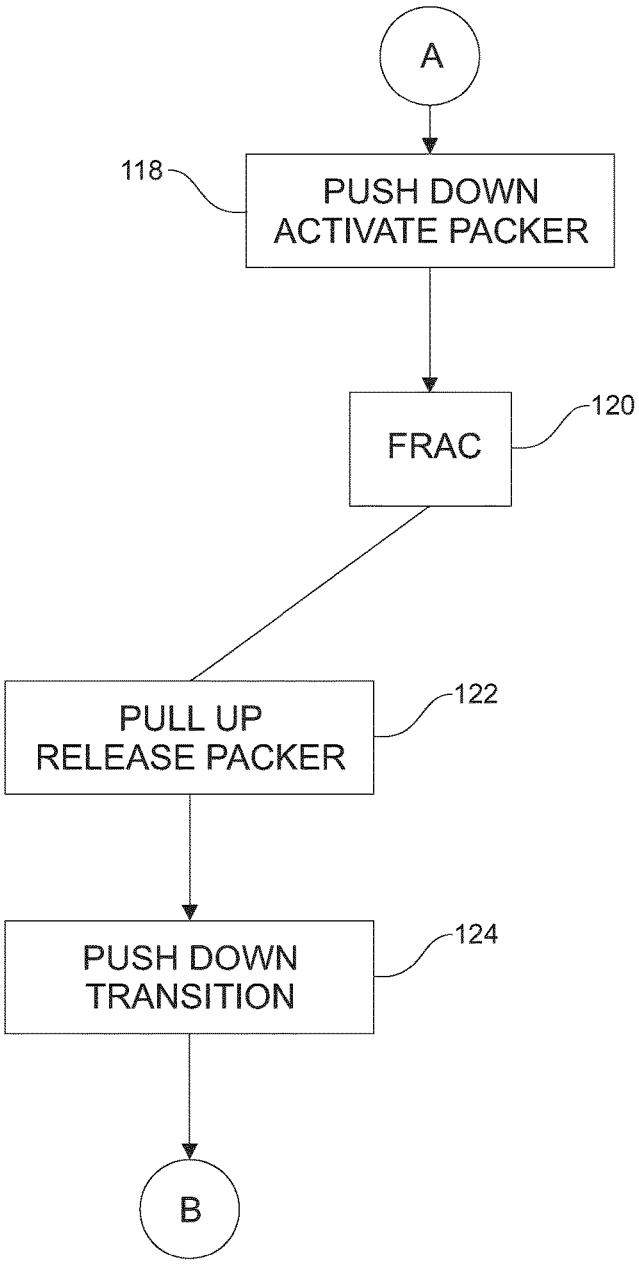
Figure 9B:
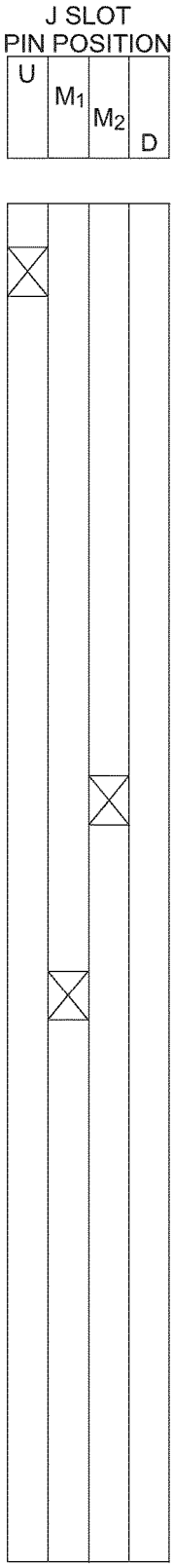
Figure 9C:
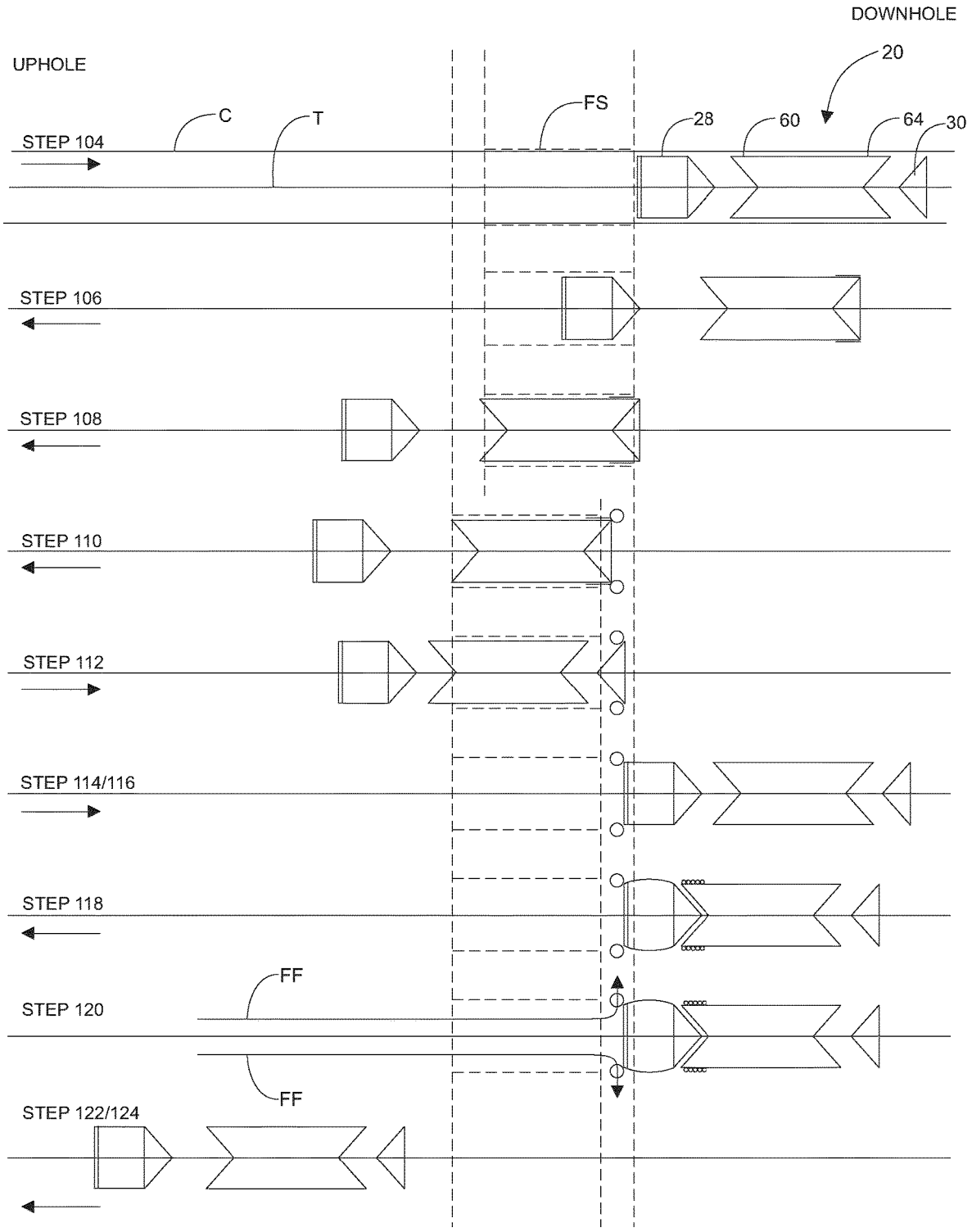
FIG. 9C is a schematic view showing various positions of the dual direction J-slot tool relative to a downhole frac sleeve when the tool is in operation.

The dual direction J-slot tool has two devices which function independently, for example: one to releasably and sealingly set the tool in the casing; and the other to releasably engage a casing tool for axial manipulation thereof. In an embodiment, as shown in FIG. 9C, the tool 20 can be manipulated by a conveyance string of tubing T and a J-slot mechanism to releasably engage a casing tool profile, such as a profile in a frac sleeve valve FS and once released, moved to set a resealable packer assembly 28 and slips 60 in the casing C to permit pressurized treatment fluid operations with the tool secure in the casing. The operation of the tool will be described in more detail hereinbelow.

With reference to FIGS. 5A to 8D, one embodiment of a dual direction J-slot tool 20 is shown having therein a dual direction J-slot mechanism (which will be described in detail hereinbelow), comprises a mandrel 22 having a first (or uphole) end 24, a second (or downhole) end 26, an outer surface, and an inner surface defining an inner axial bore extending between the uphole end and the downhole end. The tool 20 further comprises a resealable assembly 28 supported on the outer surface of the mandrel near the uphole end, a dog setting device 30 supported on the outer surface of the mandrel near the downhole end, an actuation housing 32 supported on the outer surface of the mandrel between the packer and the dog setting device. As will be described in detail hereinbelow, the tool 20 uses a J-slot mechanism having a single J-slot profile to manipulate both the uphole device (e.g. the resealable assembly) and the downhole device (e.g. the dog setting device) of the tool.

With reference to FIGS. 7A to 7D, the mandrel 22 is a tubular member having defined on its outer surface a dual direction J-slot profile 34 positioned in a mid-portion 36 of the mandrel between the uphole end 24 and the downhole end 26. In one embodiment, the uphole end is configured for connection to a downhole end of a conveyance string (not show). In other words, when coupled to the conveyance string, the tool is further downhole than the conveyance string. The tool may be coupled to the conveyance string by threaded connection or any other connection as known to those skilled in the art.

The terms "up", "down", "upper", "lower", "upward", "downward", "uphole", "downhole", etc. in the present description do not necessarily refer to a position relative to the direction of gravity. These terms merely denote the relative position in relation to the wellbore opening. For example, in the present description, the upper portion of the tubing string is closer to the wellbore opening at surface than the lower portion of the tubing string. Further, when describing the shifting of the tool, the terms "uphole", "downhole", "up", "down", "upward", "downward", etc. refer to the relative movement between the mandrel and the actuation housing, and not the movement of the mandrel or actuation housing relative to the wellbore.

Further, in this description, the terms "frac", "fracing", "treat", "treating", "treatment", "completion", "stimulation" refer to any type of wellbore treatment and/or stimulation (e.g. acidizing). These terms are used herein interchangeably and each term does not preclude other types of wellbore treatment and/or stimulation.

With reference to FIGS. 5A to 5D, the tool comprises a mandrel 22 connected to the conveyance string at the uphole end 24. The mandrel has an uphole and a downhole delimiting rings 48, 58 spread about and fixed thereto. Between the rings 48, 58 are uphole and downhole devices 28, 30, respectively. Spaced inwardly along the mandrel 22 between the devices are cones 74, 76. Between the cones is an actuation housing slidable along the mandrel between one end in a packer activated mode, the opposing end in a dog activated mode, and in between in a RIH or POOH mode. The actuation housing is fit with one half of the J-slot mechanism, in this case a pin. Correspondingly, the mandrel is fit with the slot portion of the J-slot mechanism. While the present description and figures refer to the actuation housing being fitted with the pin and the mandrel being fitted with the slot, the reverse configuration is also possible. In other words, the inner surface of the actuation housing may be fitted with the slot while the pin is fitted on the mandrel to form the complete J-slot mechanism.

Uphole ring 48 is positioned near the uphole end 24 for limiting the axial movement of device 28 towards the uphole end 24. Downhole ring 58 is positioned near the downhole end 26 for limiting the axial movement of device 30 towards the downhole end 26.

With reference to FIGS. 7A to 7D, the J-slot profile is continuous and spans the entire circumference of the mandrel and has at least one RIH slot 40, at least one packer activated ("P-SET") slot 42, at least one POOH slot 50, and at least one shift activated ("S-SET") slot 52. The P-SET slot has a length that is greater than that of the RIH slot. In other words, the distal end of the P-SET slot is closer to the uphole end than that of the RIH slot. The S-SET slot has a length that is greater than that of the POOH slot. In other words, the distal end of the S-SET slot is closer to the downhole end than that of the POOH slot.

Figure 7A:
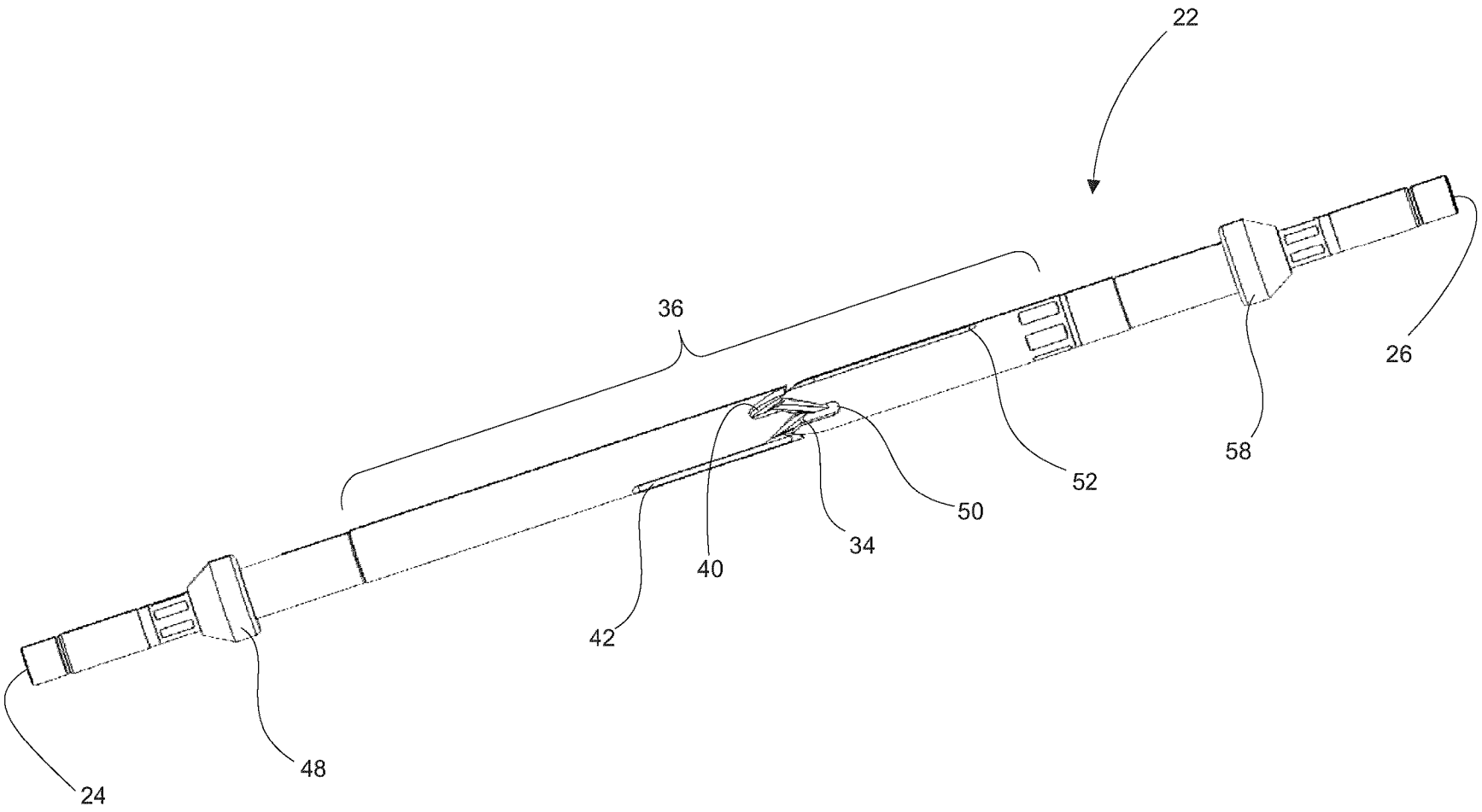
FIG. 7A is a perspective view of the mandrel of the dual direction J-slot tool, the mandrel having therein a dual direction J-slot profile, according to one embodiment.
Figure 7B:
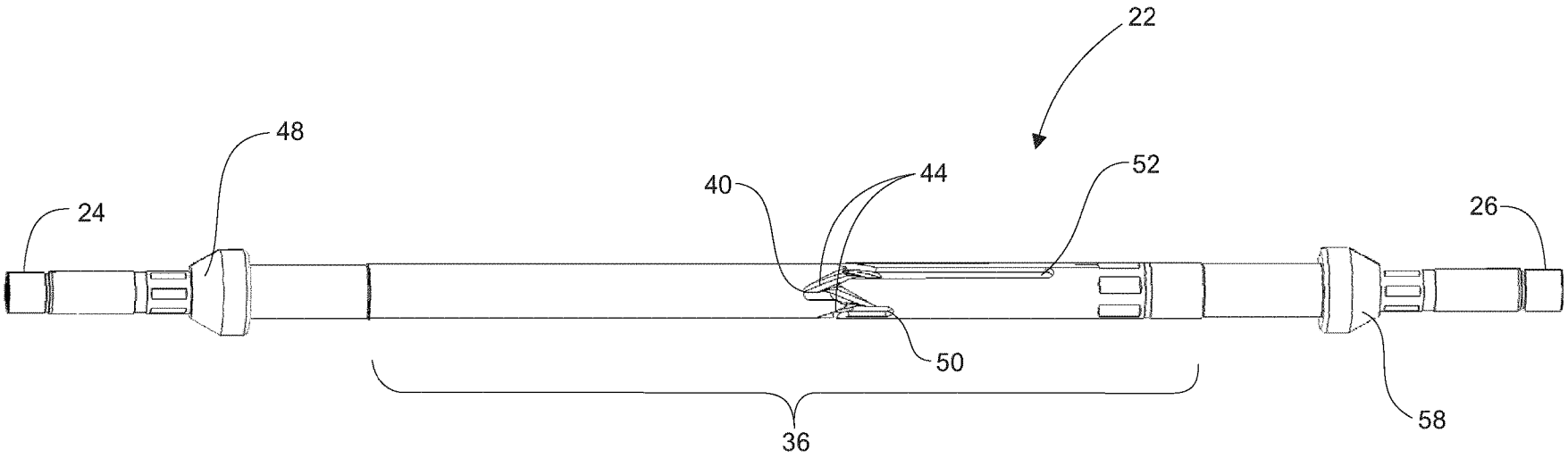
FIG. 7B is a side view of the mandrel shown in FIG. 7A.
Figure 7C:
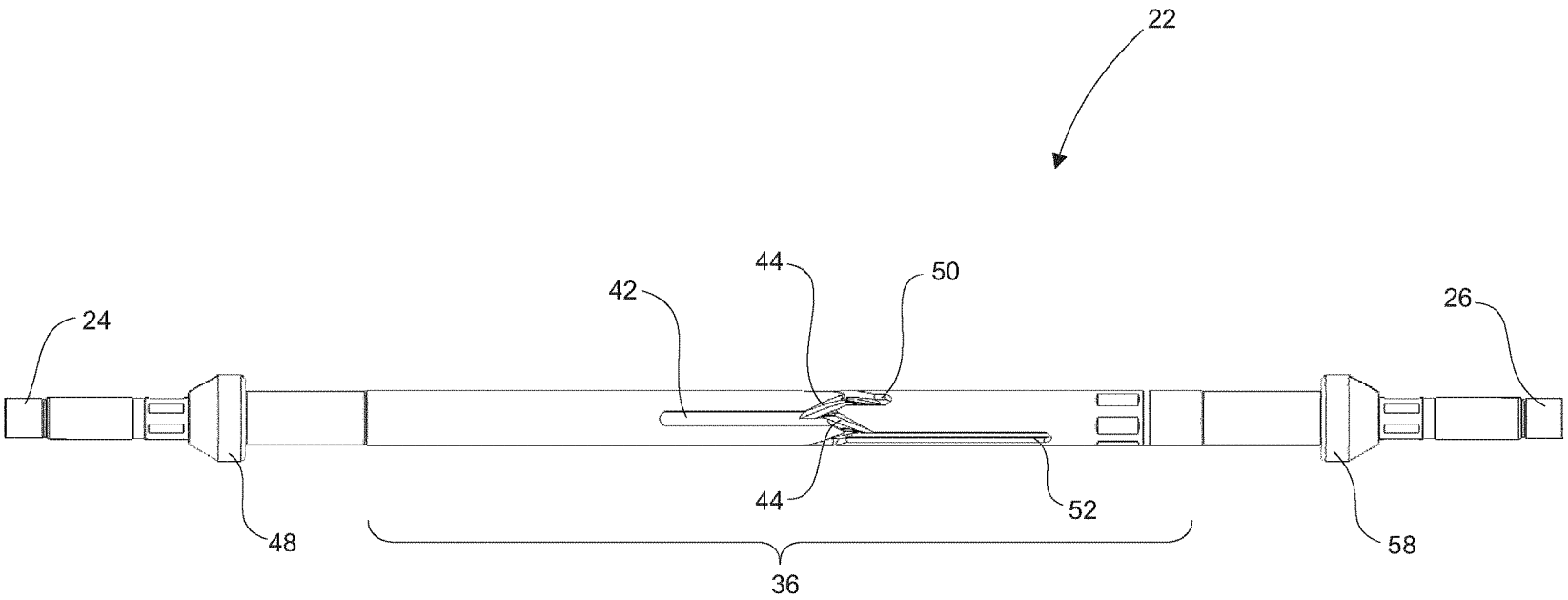
FIG. 7C is an alternate side view of the mandrel shown in FIG. 7A.
Figure 7D:
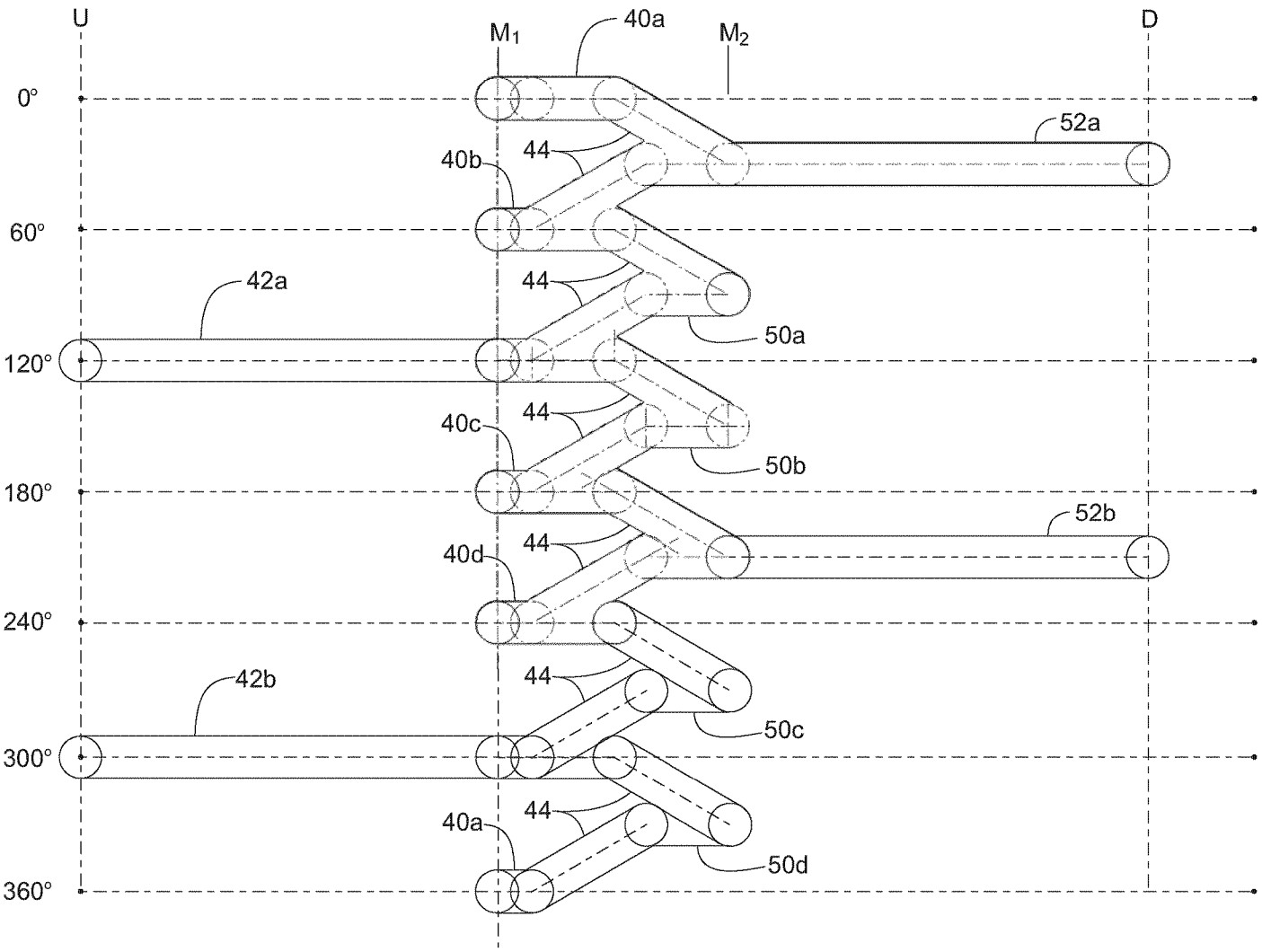
FIG. 7D is a two-dimensional depiction of the dual direction J-slot profile according to one embodiment.

FIG. 7D shows a sample embodiment of the J-slot profile in a 2-dimensional graphical rolled-out illustration. In this embodiment, the J-slot profile has four RIH slots 40*a*, 40*b*, 40*c*, 40*d*, two S-SET slots 52*a*, 52*b*, four POOH slots 50*a*, 50*b*, 50*c*, 50*d*, and two P-SET slots 42*a*, 42*b*, and spans the entire circumference of the mandrel. Adjacent slots are connected by a transition gallery 44. The reference characters "U" and "D" refer to the extreme axial locations of the distal ends of the P-SET slot and the S-SET slot, respectively. The reference characters "M1" and "M2" refer to the intermediate axial locations of the distal ends of the RIH slot and the POOH slot, respectively. The reference character U also refers to the extreme axial position of actuation housing to activate the uphole device 28 and D refers to the extreme axial position of the actuation housing to activate the downhole device 30. The reference characters M1 and M2 also refer to the intermediate uphole and downhole axial positions, respectively, of the actuation housing relative to the mandrel, wherein neither the uphole or downhole device are activated.

In embodiments where the slots extend substantially axially (e.g. FIGS. 7A to 7D), adjacent slots are connected by the transition gallery 44. Transition galleries may not be necessary in embodiments where the slots extend at an angle relative to the mandrel's long axis.

In the sample J-slot profile, the sequence of the slots in a clockwise direction when viewing the mandrel in the downhole direction is as follows: RIH slot 40*a*, S-SET slot 52*a*, RIH slot 40*b*, POOH slot 50*a*, P-SET slot 42*a*, POOH slot 50*b*, RIH slot 40*c*, S-SET slot 52*b*, RIH slot 40*d*, POOH slot 50*c*, P-SET slot 42*b*, POOH slot 50*d*. The POOH slot 50*d* connects to the RIH slot 40*a* and the above-described sequence repeats in the clockwise direction.

Preferably, the two P-SET slots 42*a*, 42*b* are separated radially from one another on the mandrel by about 180° and the two S-SET slots 52*a*, 52*b* are separated radially from one another on the mandrel by about 180°. Further, adjacent P-SET and S-SET slots are separated radially on the mandrel by about 90°. The J-slot profile may be symmetrical about a lengthwise axis of the P-SET slot and/or the S-SET slot.

The pattern of the J-slot profile may repeat more than once around the circumference of the mandrel. For example, the mandrel may have four P-SET slots and S-SET slots and eight RIH slots and POOH slots, with the same or similar sequence as described above.

Returning to FIGS. 5 and 6, the actuation housing 32 is a tubular member having an upper end, a lower end, an outer surface, and an inner surface defining an inner axial bore extending between the upper and lower ends. The actuation housing 32 comprises a set of casing slips 60 at its upper end, a set of shifting slips 64 at its lower end, and a plurality of drag blocks 62 supported on its outer surface in between the casing slips and shifting slips. The actuation housing is supported on the mandrel in a co-axial manner, with the actuation housing's upper and lower ends towards the uphole and downhole ends of the mandrel, respectively.

The mid-portion of the mandrel extends through and is received in the inner bore of the actuation housing. The casing slips are radially extendable but are spring-biased radially inwardly against the outer surface of the mandrel in a retracted position. The casing slips have a textured outer surface for frictional engagement with the inner surface of the casing when the casing slips are radially outwardly extended. The shifting slips are radially extendable but are spring-biased radially inwardly against the outer surface of the mandrel in a retracted position. The drag blocks are spring-biased to extend radially outwardly such that the drag blocks extend radially beyond the outer surface of the actuation housing. The drag blocks frictionally restrain the actuation housing 32 to function the J-slot mechanism (i.e. to allow the relative axial shifting between the mandrel and the actuation housing).

With reference to FIG. 8, the actuation housing further comprises springs 66, 67, and 68 for biasing the casing slips, drag blocks, and shifting slips, respectively, as described above. In addition to the J-slot profile, the dual direction J-slot mechanism further comprises one or more pins extending radially inwardly from the inner surface of the actuation housing for engagement with the J-slot profile of the mandrel. The pins are sized and configured to travel in the J-slot profile and to transition from one slot to an adjacent slot.

In the illustrated embodiment, the actuation housing has a pair of pins 70*a*, 70*b* that are fixedly positioned at about the same axial location but are separated radially from one another in the inner bore of the actuation housing by 180°. The pins extend radially into the J-slot profile for sliding engagement with and following the J-slot profile. When one pin 70*a* of the two pins is in any one of the slots, the other pin 70*b* is in another duplicate slot that is directly opposite to (i.e. separated by 180° radially from) that slot. For example, if pin 70*a* is in the RIH slot 40*b*, pin 70*b* is in the RIH slot 40*d*.

Other numbers of pins than that specifically described may be used for the J-slot mechanism and tool, so long as the number of repeating slot patterns in the J-slot profile is equal to or a multiple of the number of pins. For example, if the slot pattern repeats once (i.e. there are two of the same slot pattern) in the J-slot profile, as shown in the illustrated embodiment, or if there are four of the same slot pattern repeated in the J-slot profile, then two pins are used. If there are three or six of the same slot pattern repeated in the J-slot profile, then three pins may be used. Depending on the magnitude of the radial separation, the pins may or may not be fixed to the inner surface of the of the actuation housing at the same axial location.

With reference to FIGS. 5A to 5D and 8A to 8D, the packer 28 comprises an expandable packer element 72 and a packer actuation cone 74 adjacent to the packer element. In other words, the packer element is sandwiched between uphole ring 48 and cone 74. The packer actuation cone 74 is slidable axially on the mandrel 22. The packer element is activated (i.e. expanded) when the cone 74 pushes the packer element axially against ring 48 in the direction towards the upper end of the mandrel (see FIGS. 5D and 6D). When actuated, the packer is extended radially outwardly to engage the inner surface of the wellbore casing to provide a fluid seal between an upper section of the casing and a lower section of the casing.

The packer actuation cone 74 has a frustoconical section for receiving casing slips 60 thereon. The dog setting device 30 has an actuation cone 76 with a frustoconical section for receiving shifting slips 64 thereon.

With reference to FIGS. 5A, 5C, 6A, 6C, 8A and 8C, the actuation housing is supported on the mandrel near the midpoint thereof when the pins 70*a*, 70*b* are in the RIH slots or POOH slots, the casing slips 60 and the shifting slips 64 are spaced away from, and not in contact, with uphole device 28 and downhole device 30, respectively. More specifically, when the pins are in the RIH slots, the tool 20 is in the RIH position, wherein the packer 28, the casing slips 60, and the shifting slips 64 are all in the retracted position (see FIGS. 5A, 6A, and 8A). When the pins are in the POOH slots, the tool 20 is in the POOH position, wherein the packer, the casing slips, and the shifting slips are also all in the retracted position (see FIGS. 5C, 6C, and 8C). The actuation housing in the POOH position is closer to the downhole end of the mandrel than in the RIH position.

Figure 1A:
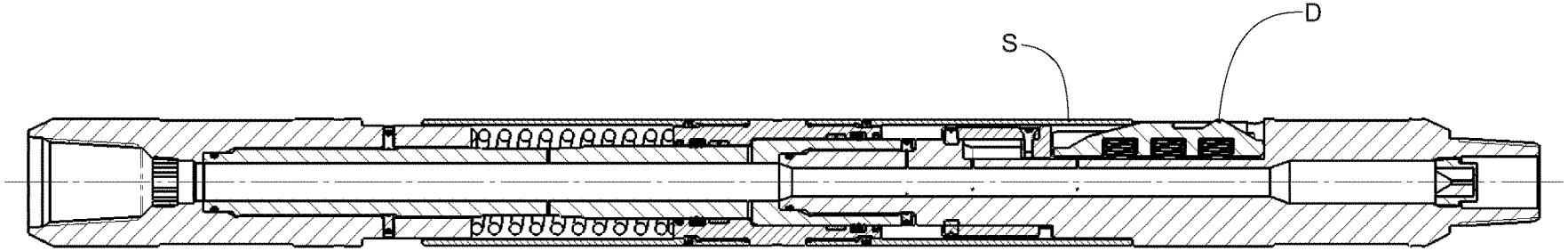
Fig. 1A PRIOR ART
FIG. 1A is a cross-sectional view of a prior art shifting tool having shifting dogs shown in the retracted position.
Figure 1B:
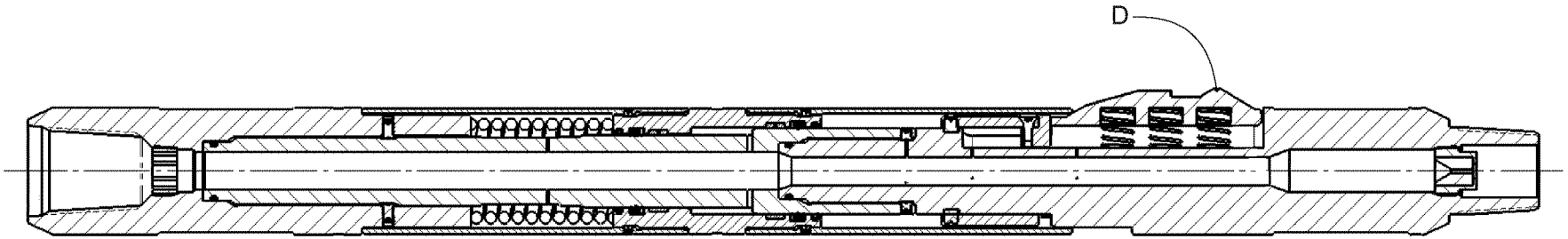
Fig. 1B PRIOR ART
FIG. 1B is a cross-sectional view of the shifting tool shown in FIG. 1A, wherein the shifting dogs are shown in the expanded position.
Figure 2:
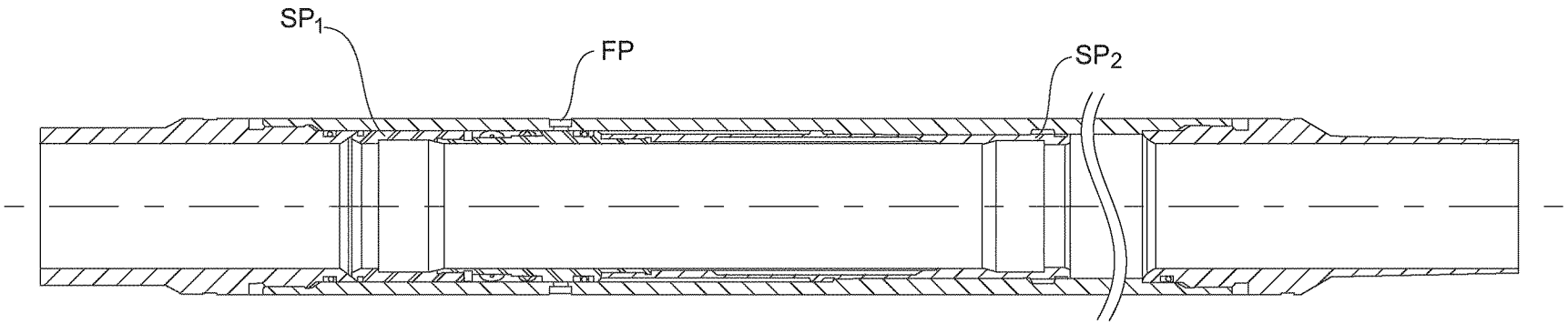
Fig. 2 PRIOR ART
FIG. 2 is a cross-sectional view of another prior art frac sleeve.
Figure 3:
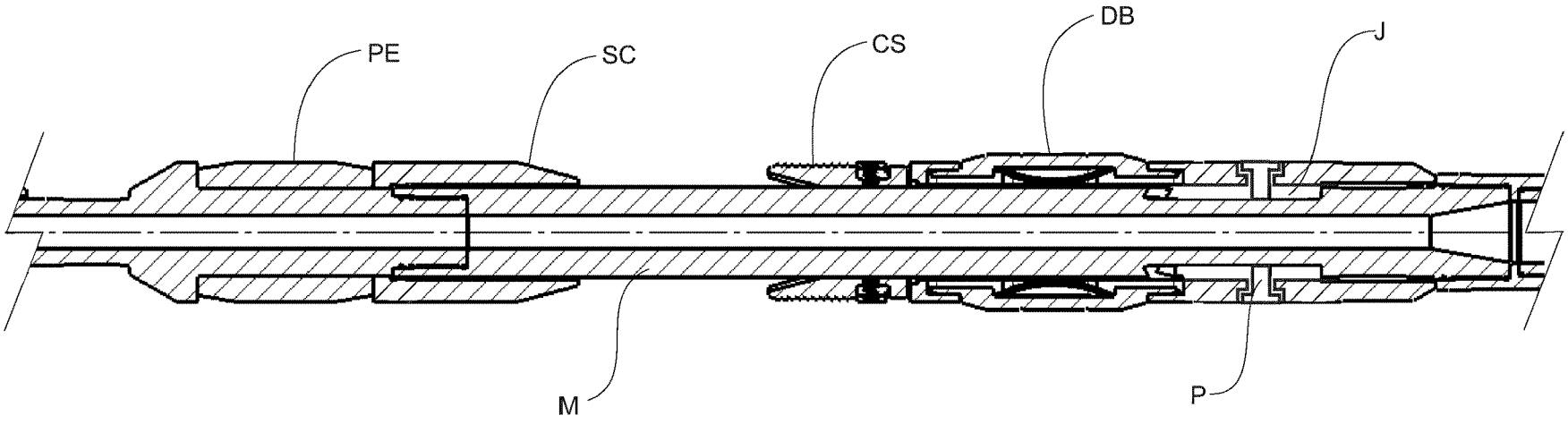
Fig. 3 PRIOR ART
FIG. 3 is a cross-sectional view of a prior art J-slot packer tool.
Figure 4:
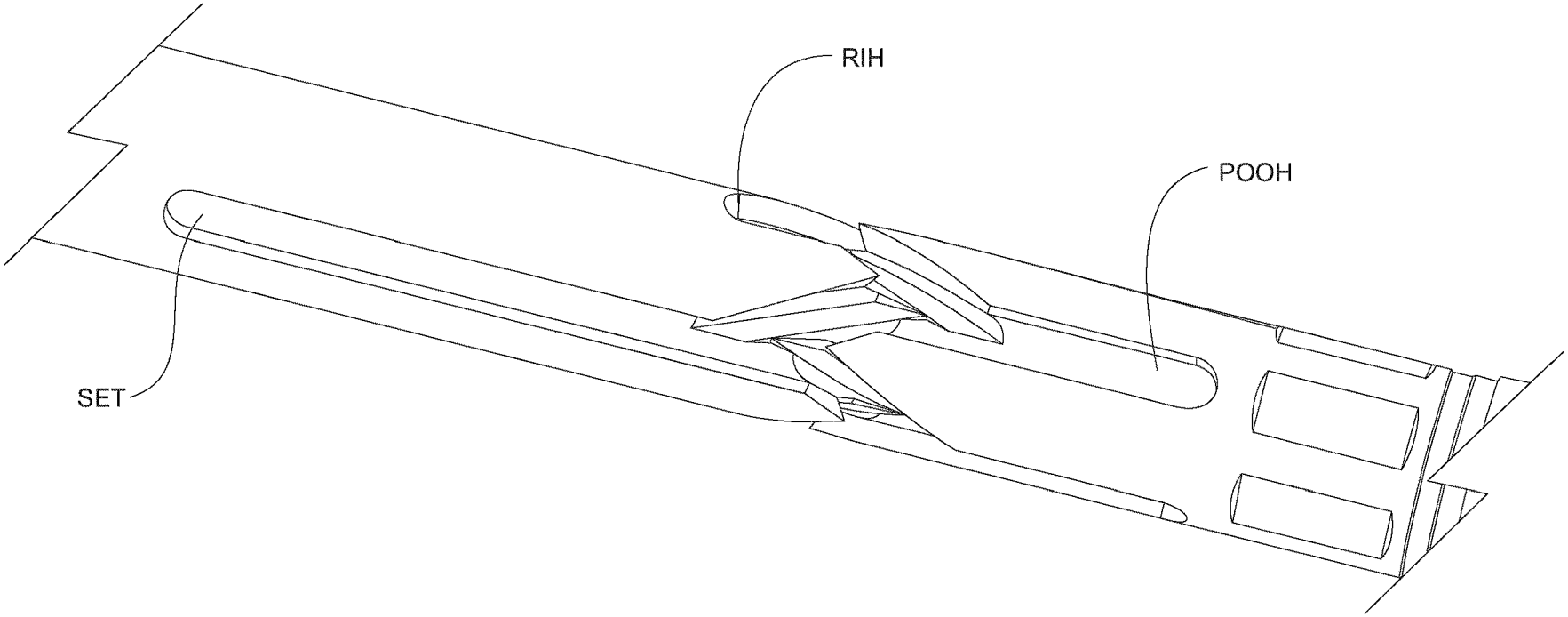
Fig. 4 PRIOR ART
FIG. 4 is a partial perspective view of a mandrel usable with the J-slot packer tool shown in FIG. 3.
Figure 5A:
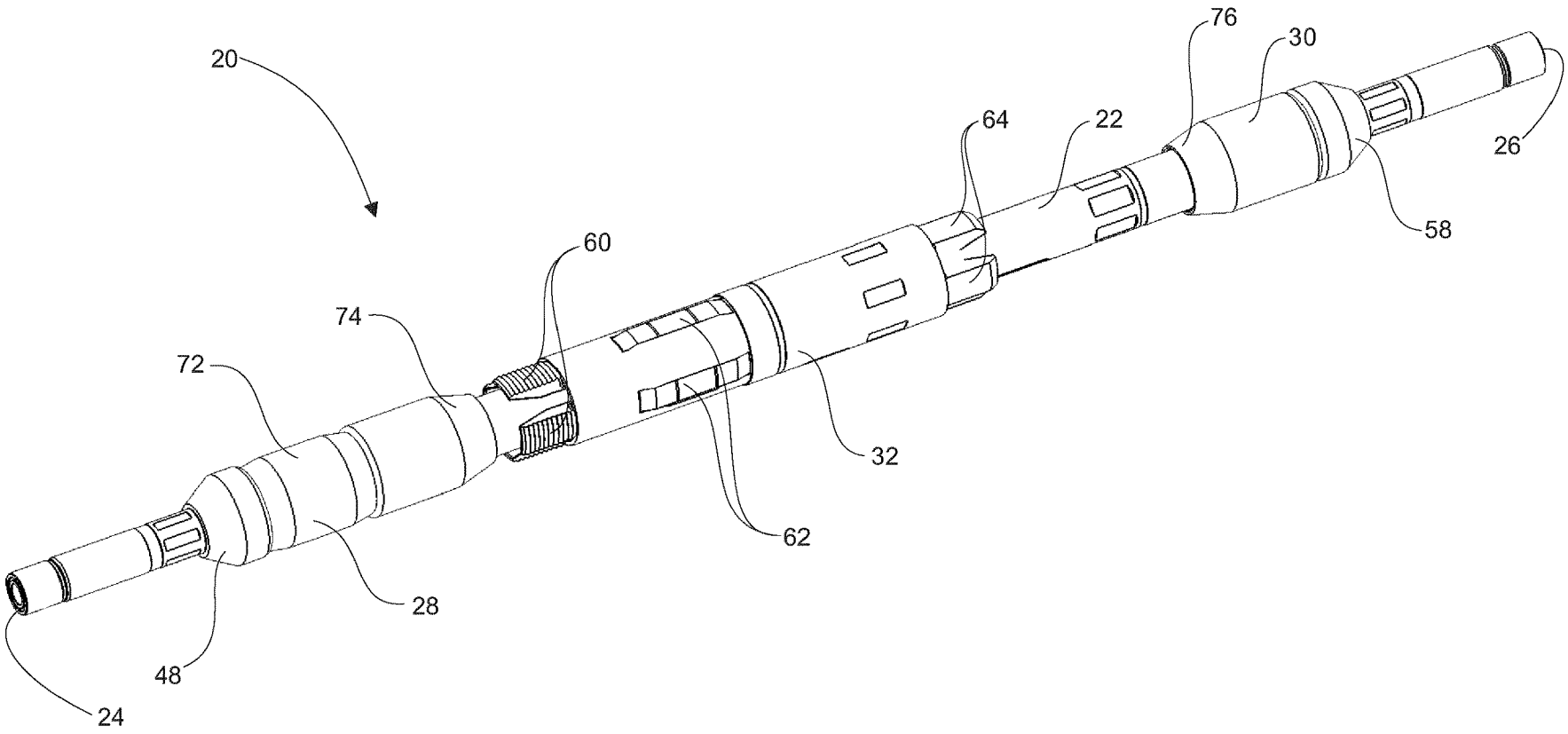
FIG. 5A is a perspective view of a dual direction J-slot tool in accordance with one embodiment, shown in the run-in-hole position.
Figure 5B:
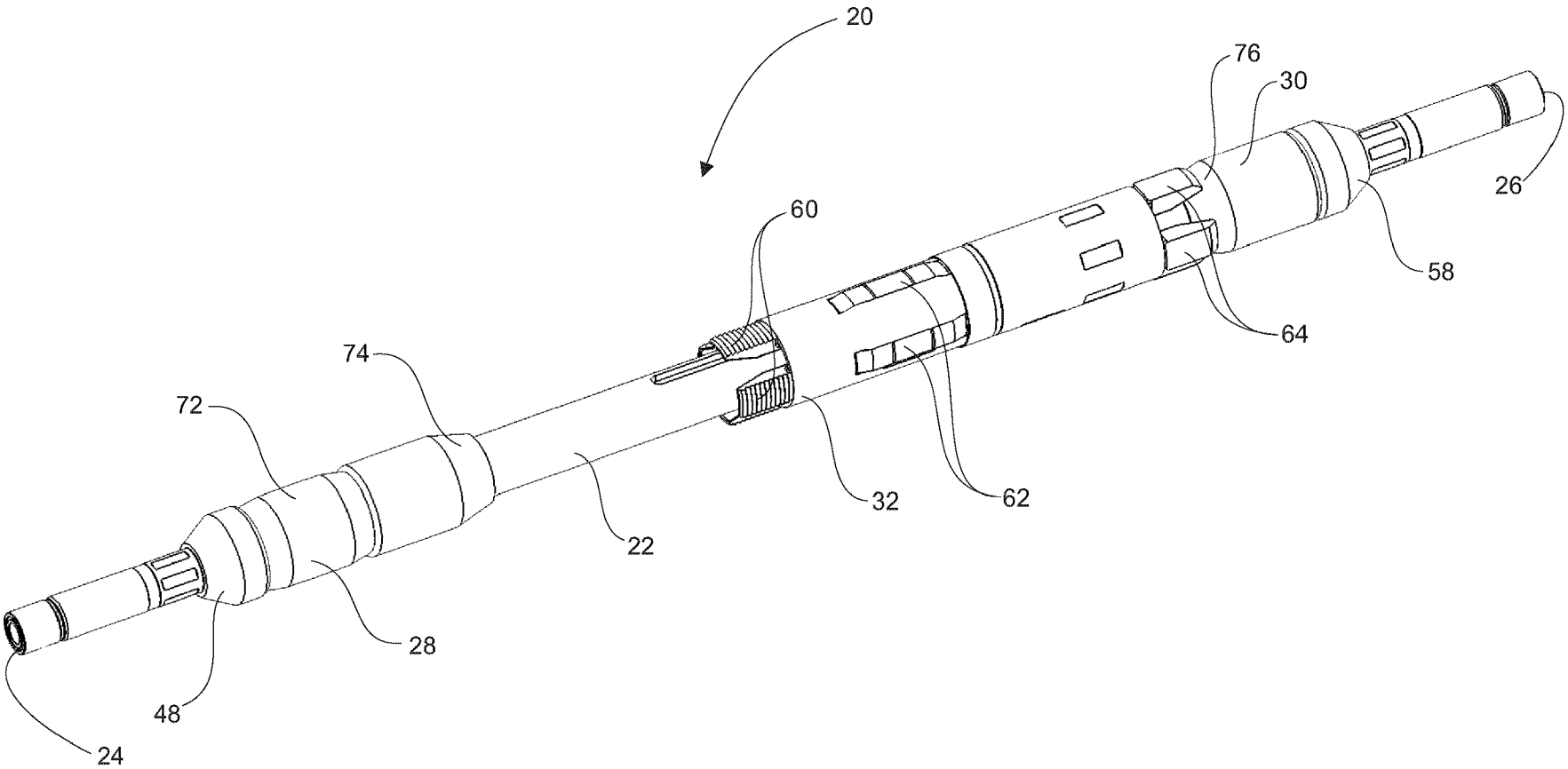
FIG. 5B is a perspective view of the dual direction J-slot tool of FIG. 5A, shown in the shift position.
Figure 5C:
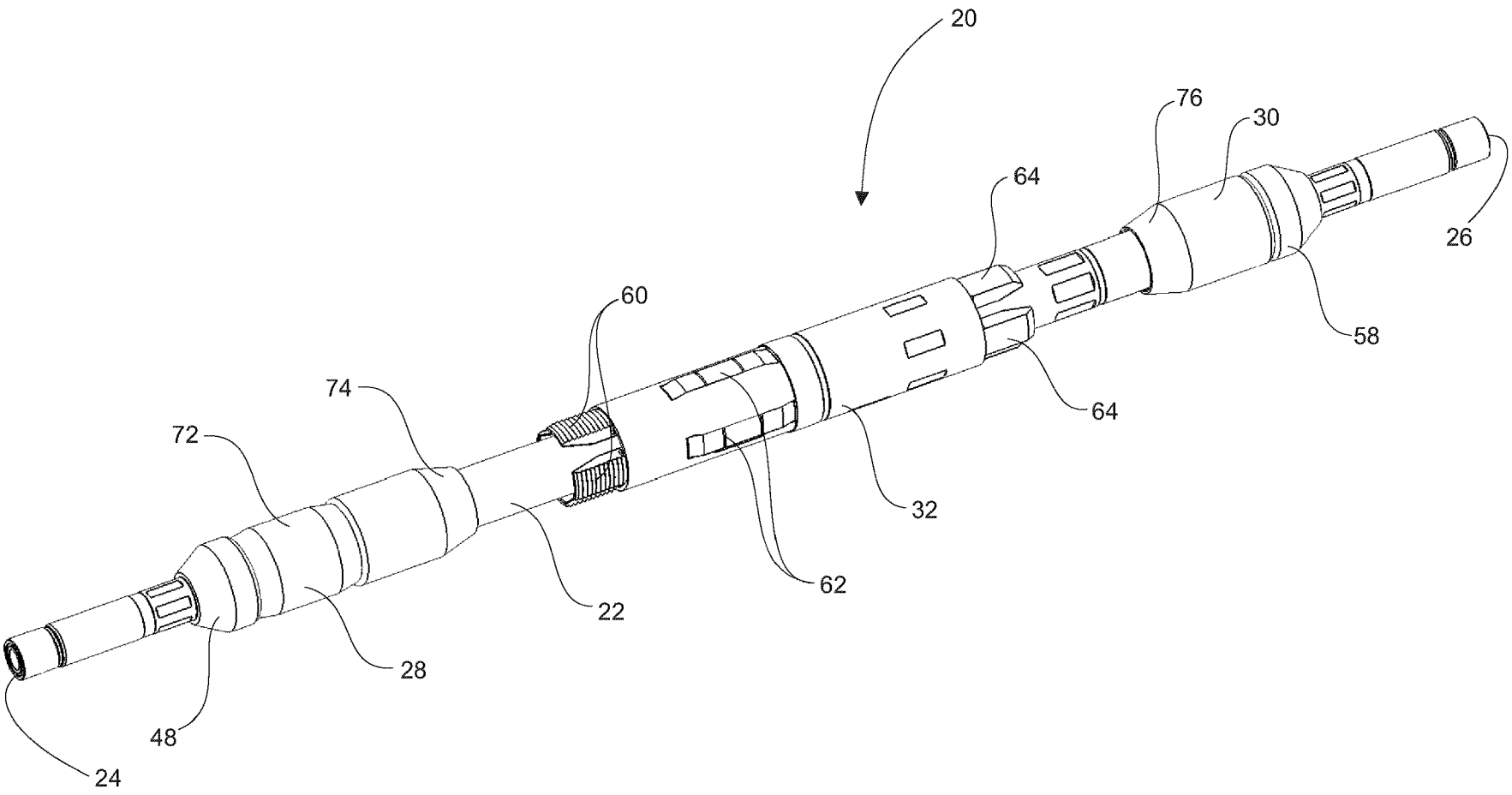
FIG. 5C is a perspective view of the dual direction J-slot tool of FIG. 5A, shown in the pull-out-of-hole position.
Figures 6A, 6B:
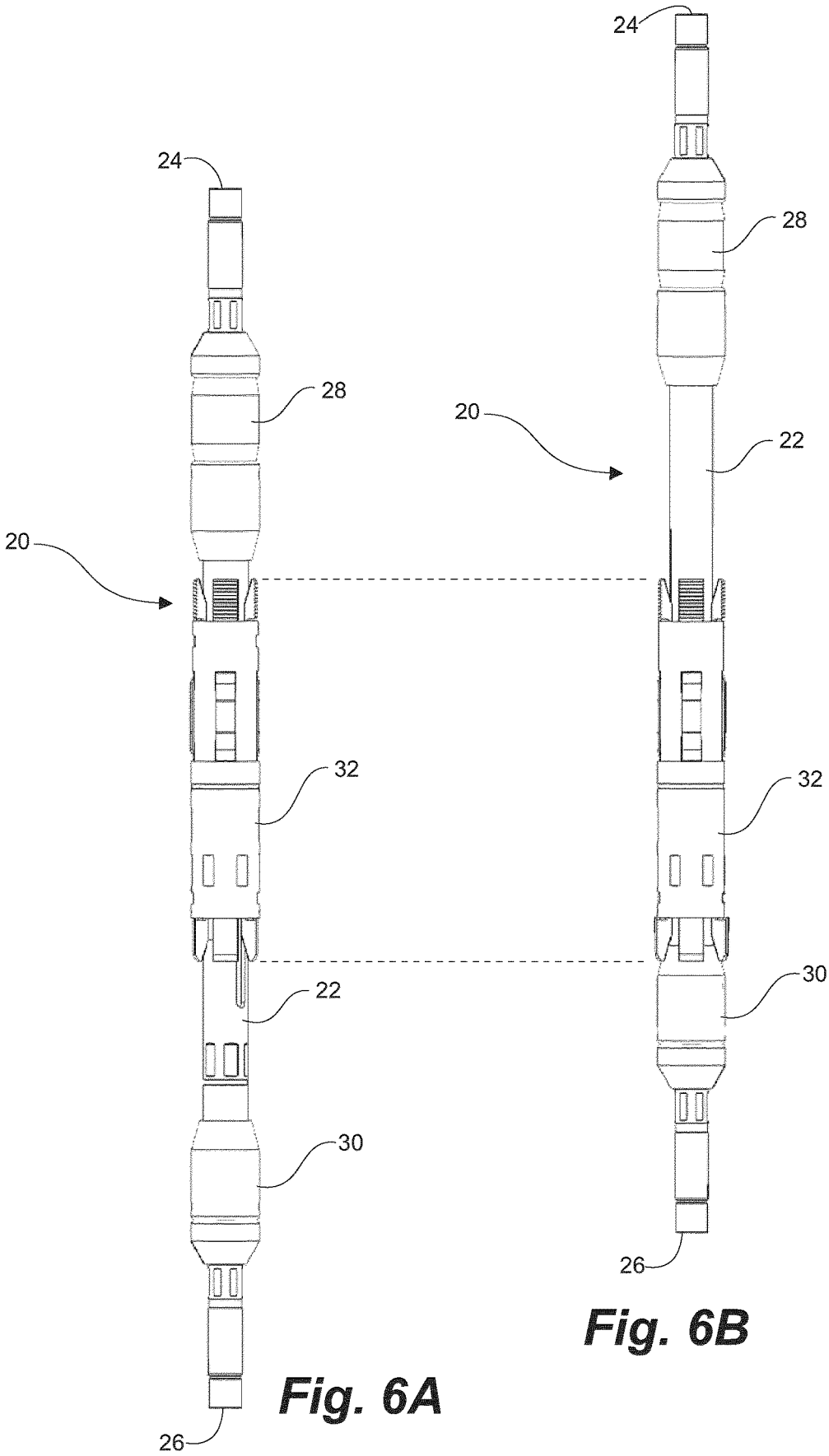
FIGS. 6A, 6B, 6C, and 6D are each a side view of the dual direction J-slot tool of FIG. 5A, shown in the run-in-hole position, shift position, pull-out-of-hole position, and set position, respectively, to illustrate the relative position of the mandrel to the actuation housing in each position.
Figure 6C:
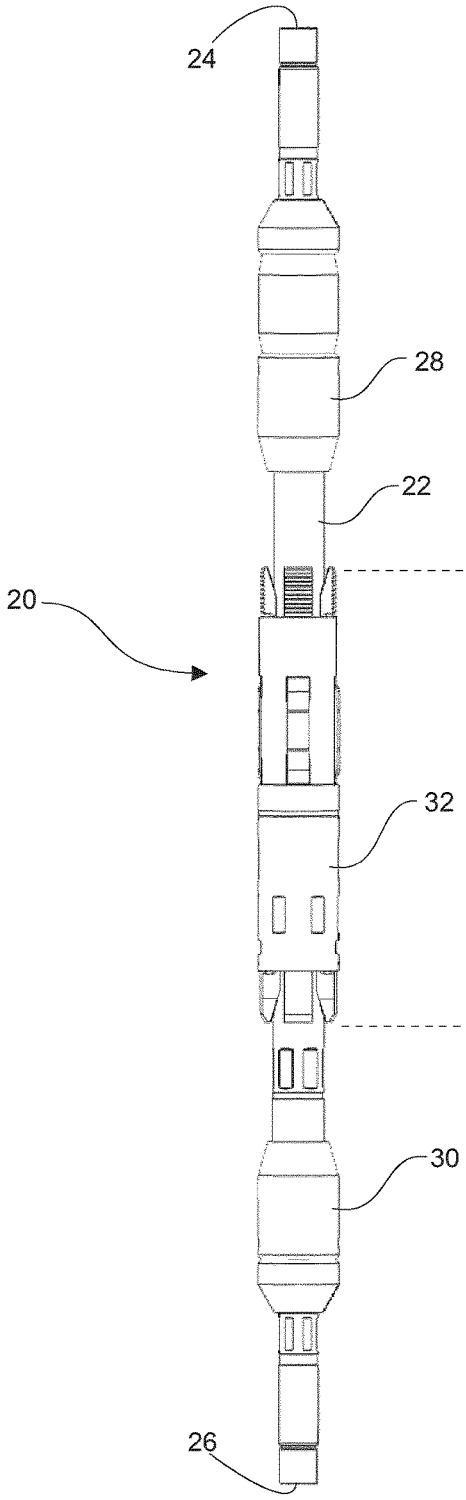
Figure 8A:
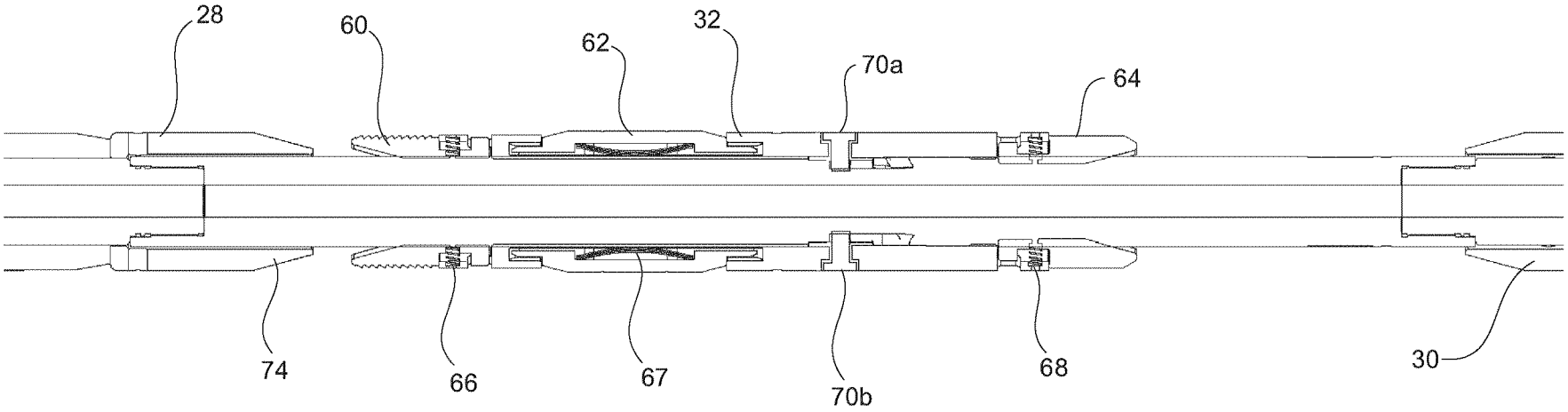
FIGS. 8A, 8B, 8C, and 8D are each a partial cross-sectional view of the dual direction J-slot tool of FIG. 5A, shown in the run-in-hole position, shift position, pull-out-of-hole position, and set position, respectively.
Figure 8B:
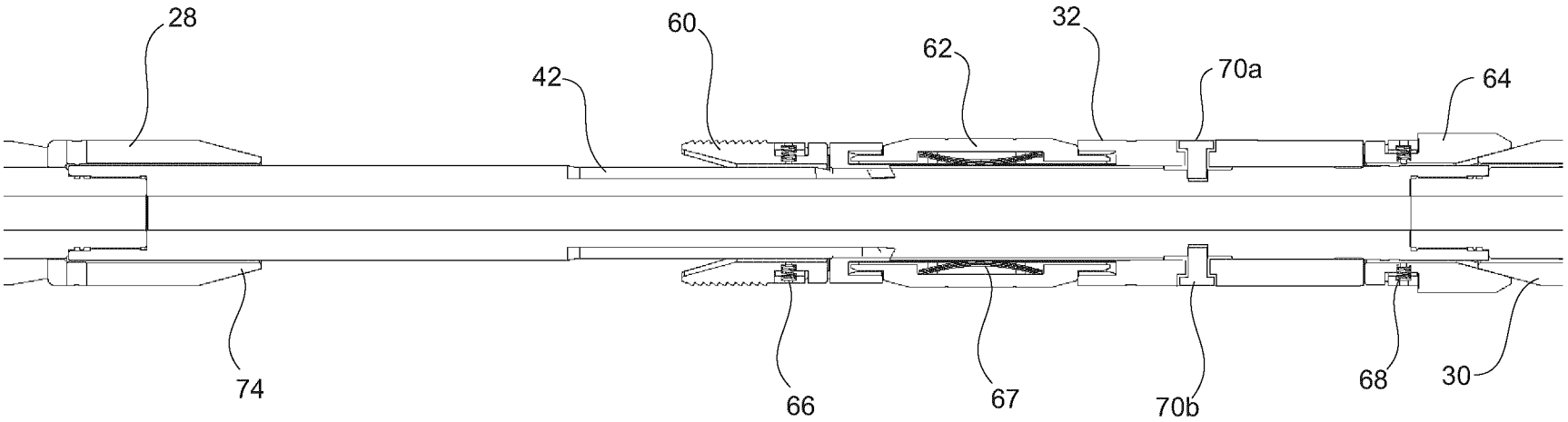
Figure 8C:
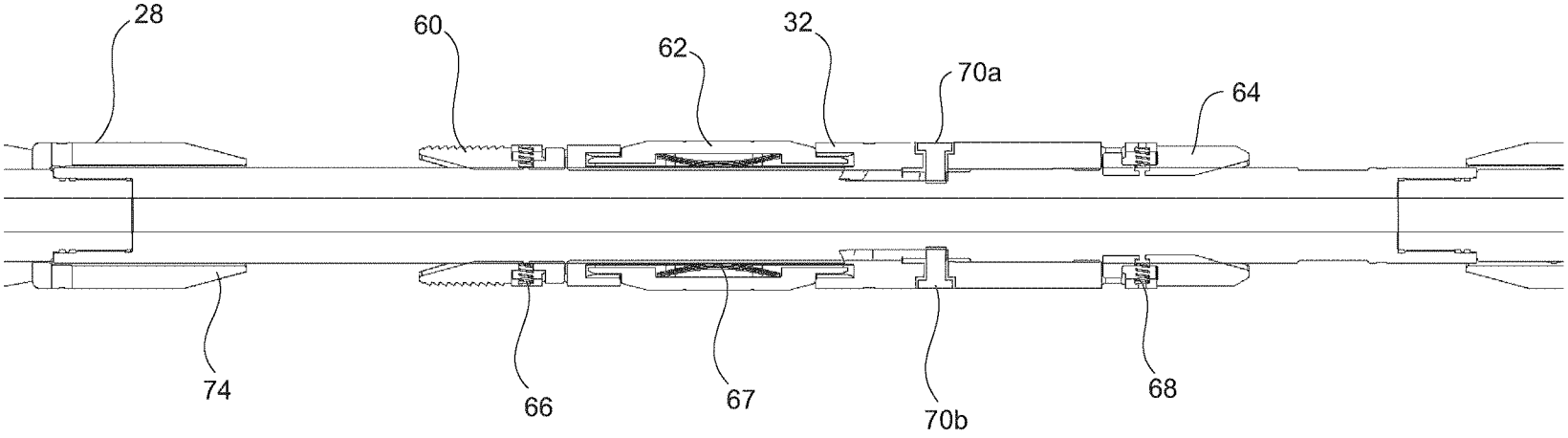

With reference to FIGS. 5B, 6B, and 8B, the mandrel is moved uphole relative to the actuation housing to place the pins 70*a*, 70*b* at or near the distal ends of the S-SET slots (i.e. the D position). The relative upward movement of the mandrel urges the shifting slips 64 on to the frustoconical section of cone 76 of the dog setting device 30, whereby the shifting slips are expanded radially outwardly for engaging the profile of a corresponding frac sleeve. When the shifting slips are in the expanded position, the tool is in a "shift activated" (S-SET) position.

Figure 5D:
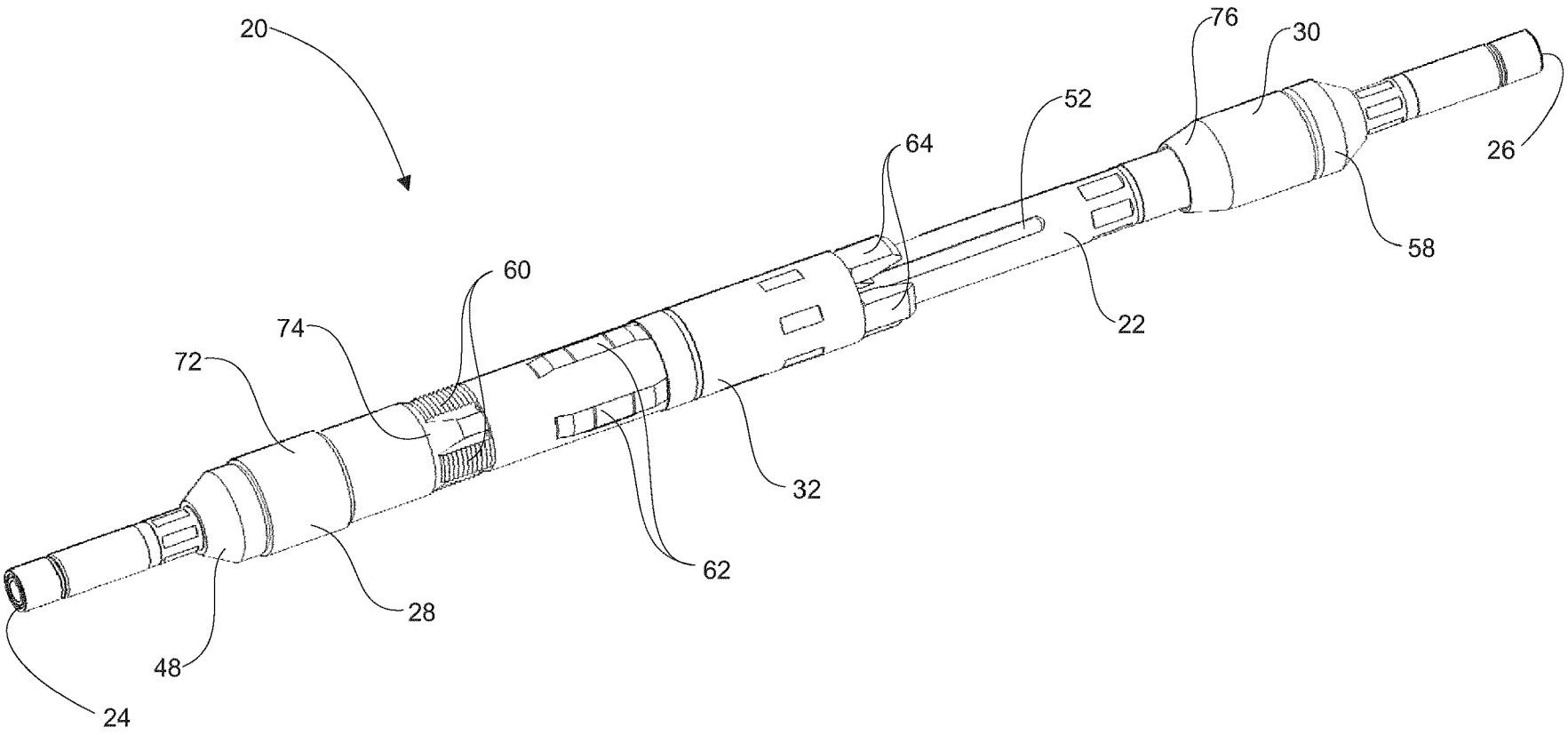
FIG. 5D is a perspective view of the dual direction J-slot tool of FIG. 5A, shown in the set position.
Figure 6D:
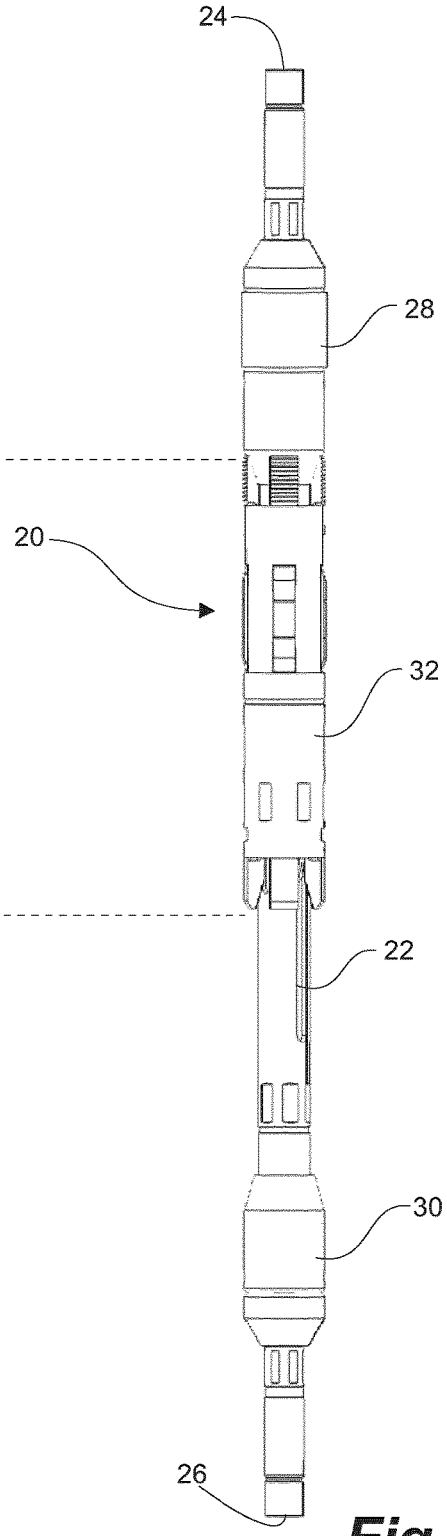
Figure 8D:
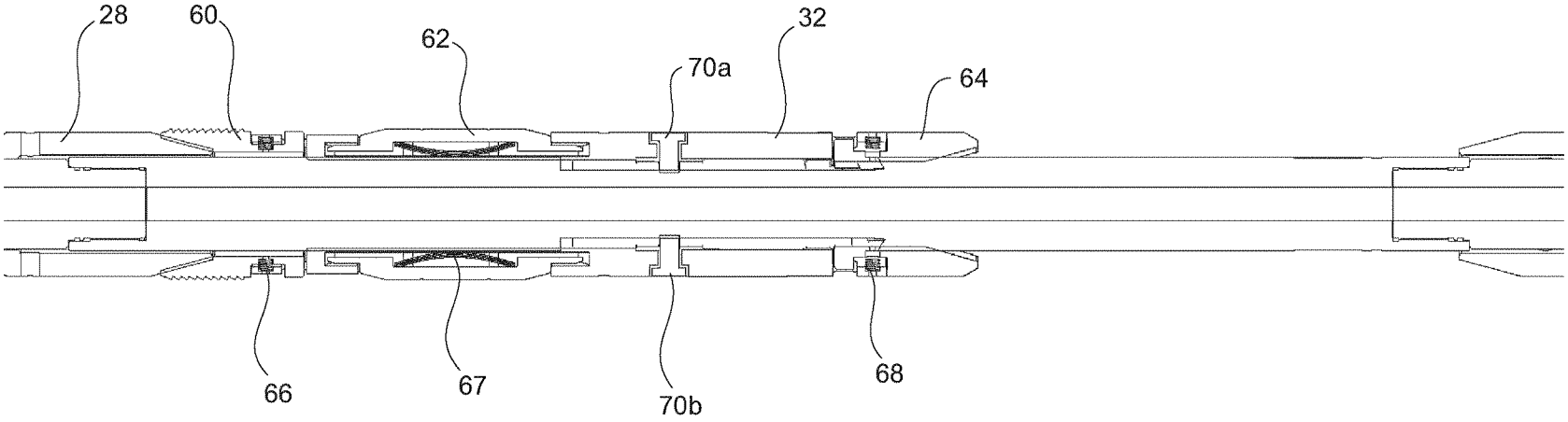

With reference to FIGS. 5D, 6D, and 8D, the mandrel is moved downhole relative to the actuation housing to place the pins 70*a*, 70*b* at or near the distal ends of the P-SET slots (i.e. the U position). The relative downward movement of the mandrel urges the casing slips 60 on to the frustoconical section of the cone 74, whereby the packer element is actuated by the cone 74 and the casing slips are expanded radially outwardly, for engaging the inner surface of the wellbore casing. When the packer element is actuated (i.e. expanded radially outwardly), the tool is in a "packer activated" (P-SET) position.

The tool 20 is transitioned between the RIH, S-SET, POOH and P-SET positions by pushing and pulling on the mandrel to move the mandrel axially downhole and uphole relative to the actuation housing to cycle the pin into and out of the various slots sequentially in the J-slot profile of the mandrel. For example, to move the pin into the RIH slot or P-SET slot (or to move the pin out of the POOH slot or S-SET slot), the mandrel is pushed downhole relative to the actuation housing. Likewise, to move the pin into the POOH slot or S-SET slot (or to move the pin out of the RIH slot or P-SET slot), the mandrel is pulled uphole relative to the actuation housing. The pin is usually cycled through the J-slot profile around the mandrel circumferentially in a clockwise direction when viewing the tool from its uphole end. The actuation housing may rotate about the mandrel as the pin is cycled through the J-slot profile.

FIGS. 7D and 9A to 9C illustrate the operation of the tool 20 according to a sample embodiment. With reference to FIGS. 7D, 9A to 9C, the process 100 for operating the tool 20 begins at step 101. Prior to run in, the tool is coupled to the conveyance string T and is checked (step 102) to ensure that it is in a start cycle RIH position (i.e. the pins are in the M1 position of the RIH slots 40*a* and 40*c*). If the tool is not in the start cycle RIH position, the pins are cycled through the J-slot profile by pushing and pulling on the mandrel until they are in the RIH slots 40*a*, 40*c*. If the tool is in the start cycle RIH position, the tool is run into the wellbore to a location below a frac sleeve FS to be shifted open by the tool, e.g. the lowermost frac sleeve (step 104). In order to move the tool downhole, the forces exerted on to the mandrel are sufficient to overcome the frictional forces between the drag blocks and the inner surface of the casing C.

The pins are secured in the M1 position of slots 40*a*, 40*c* as the entire tool is being run in. Once the tool is below the frac sleeve, the mandrel is pulled up. As the mandrel is being pulled upwards, the pins slide along the RIH slots 40*a*, 40*c* and into the S-SET slots 52*a*, 52*b* via transition galleries 44, thereby placing the pins in the D position and accordingly placing the tool in the S-SET position (step 106) wherein the shifting slips are expanded.

After the shifting slips are expanded, the upward force on the mandrel is increased to move the entire tool upwards in order to locate the frac sleeve profile. The shifting slips are configured to have a sufficient effective outer diameter to latch into the frac sleeve profile when the shifting slips are in the expanded position. The frac sleeve profile can withstand a certain amount of upward force (e.g. about 6,000 to about 8,000 lbs) prior to being shifted open. For example, the frac sleeve may include a shear pin with a breaking threshold of around 8,000 lbs. Therefore, to locate the sleeve profile, the tool is pulled upwards until a pulling force that is near but less than the shear pin threshold is reached (step 108).

Once the frac sleeve profile is located, additional pulling force is exerted on the mandrel to break the shear pins to open the frac sleeve (step 110). After the frac sleeve is opened, a downward force is exerted on the tool to move the mandrel downwards relative to the actuating housing. As the mandrel moves downwards, the pins slide along the S-SET slots 52*a*, 52*b* and into the adjacent RIH slots 40*b*, 40*d*, respectively, thereby retracting the shifting slips by disengaging the dog setting device 30 therefrom and then transitioning the tool into the RIH position (step 112). At step 112, the pins are in the M1 position. The downward force is then increased to push the entire tool further downhole until the packer 28 is below the opened frac sleeve (step 114).

The mandrel is then pulled up relative to the actuation housing to slide the pins along the RIH slots 40*b*, 40*d* and into POOH slots 50*a*, 50*c*, to transition the tool into the POOH position (step 116). At step 116, the pins are in the M2 position. To activate the packer element, the mandrel is pushed down relative to the actuation housing to move the pins from the POOH slots 50*a*, 50*c* to the P-SET slots 42*a*, 42*b* into the U position, thereby placing the tool into the P-SET position (step 118).

In the P-SET position, the expanded packer provides a fluid seal between the portion of the casing above the packer and the portion of the casing below the packer. Treatment fluid FF is then pumped down the tubing string and/or the casing annular space and exits through the opened frac sleeve into the formation (step 120). After the desired amount of treatment fluid has been pumped into the formation, the mandrel is pulled up relative to the actuation housing to move the pins from the U position to the M2 position (i.e. the pins are moved to the adjacent POOH slots 50*b*, 50*d*), thereby disengaging the casing slips from the packer actuation cone 74 and deactivating (i.e. retracting) the packer element 72 (step 122). Step 122 places the tool in the POOH position.

Before moving the tool to the next frac sleeve to be opened, the mandrel is pushed down relative to the actuation housing in order to transition the tool from the POOH position into the RIH position, wherein the pins are in the M1 position (step 124). The mandrel is then pulled up relative to the actuation housing to move the pins from the M1 position to the D position, thereby placing the tool in the S-SET position (step 106). Once the tool is in the S-SET position, the upward force on the mandrel is increased to move the entire tool upwards to locate the frac sleeve profile of the next frac sleeve to be opened and the above described steps 108, 110, 112, 114, 116, 118, 120, 122 and 124 are repeated, respectively, as described above, until the formation is treated as desired.

Figure 9D:
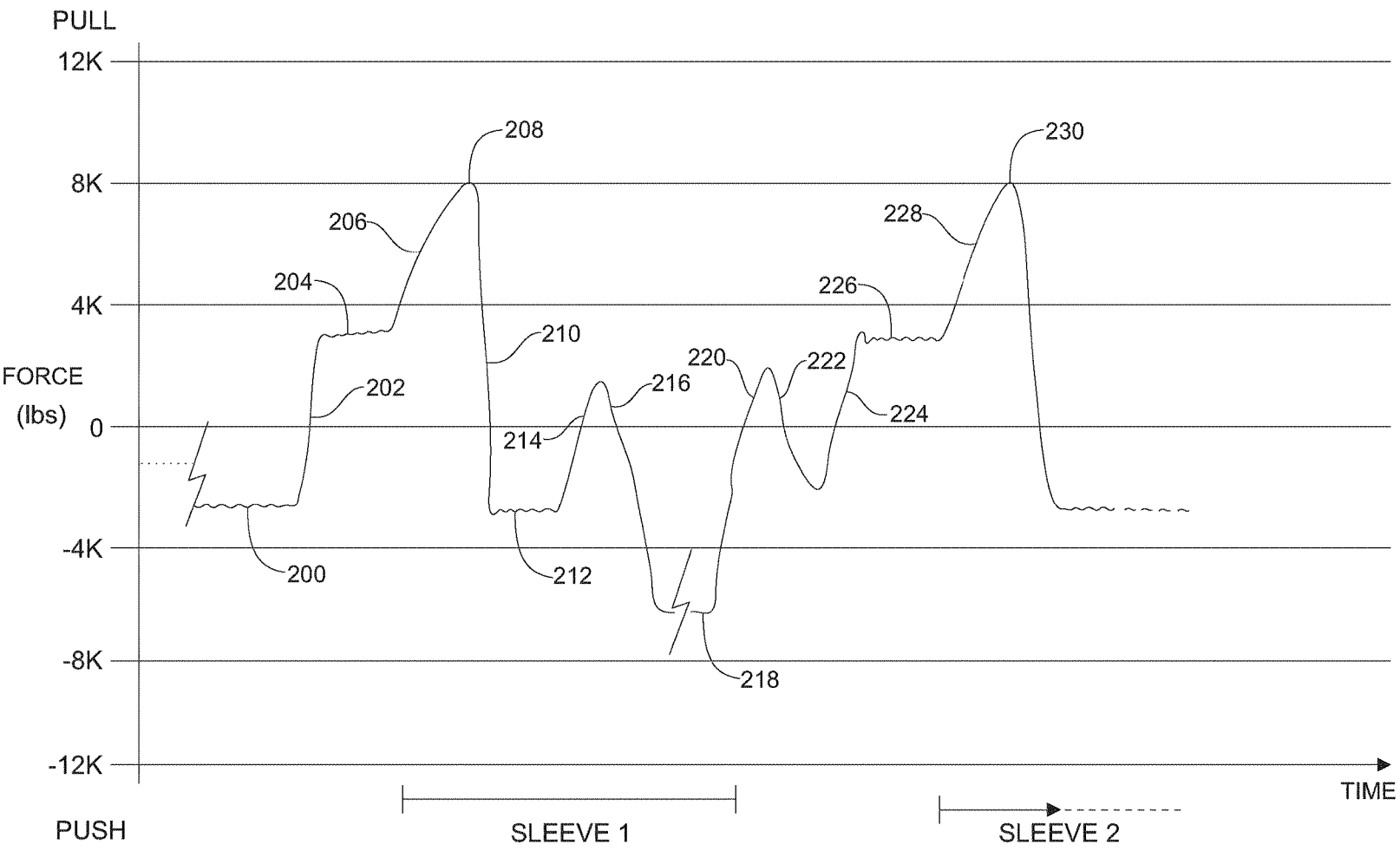
FIG. 9D is a graph illustrating the forces on the mandrel according to a sample embodiment, when the dual direction J-slot tool is in operation.

FIG. 9D is a graph showing the sample forces on the mandrel throughout the operation of the tool. The magnitudes shown are examples only. In reality, the tool may experience different magnitudes of forces. At the start, the tool is in the RIH position where the pins are in the RIH slots 40*a*, 40*c* and it is run into the wellbore by a downward force 200 that is sufficient to overcome the frictional forces between the drag blocks and the casing. When the tool reaches below the frac sleeve to be opened, an upward force 202 is exerted on the mandrel that is sufficient to move the mandrel upwards relative to the actuation housing. The tool is thereby transitioned to the S-SET position wherein the shifting slips are expanded. The upward force is then increased to move the entire tool upwards (204).

When the shifting slips encounter the frac sleeve profile, the tool is initially restricted from moving upwards, such as with shear pins, even with an increasing upward force 206 exerted thereon. However, once the magnitude of the upward force 208 reaches the shear pin threshold of the frac sleeve (e.g. 8,000 lbs), the shear pin breaks and the frac sleeve shifts open. Once the sleeve is opened, the force on the mandrel is switched to a downward force 210 to move the pins to the next slots 40*b*, 40*d*, thereby transitioning the tool to the RIH position. The downward force 212 is then increased to move the entire tool downwards until it is below the opened frac sleeve.

Once the tool is below the opened frac sleeve, an upward force 214 is exerted on the mandrel to move the mandrel upwards relative to the actuation housing to move the pins to the next slots 50*a*, 50*c*, thereby transitioning the tool to the POOH position. A downward force 216 is then exerted on the mandrel to move the pins to the next slots 42*a*, 42*b*, thereby transitioning the tool to the P-SET position wherein the casing slips engages the casing and the packer element is expanded to provide a fluid seal. Treatment can then take place through the opened frac sleeve (218).

After the treatment is completed through opened frac sleeve, an upward force 220 is exerted on the mandrel to shift the pins out of the P-SET slots 42*a*, 42*b*, to disengage the casing slips and retract the packer element. As the mandrel is continued to be pulled upwards relative to the actuation housing, the pins are moved to the next slots 50*b*, 50*d*, thereby transitioning the tool into the POOH position. A downward force 222 is then exerted on the mandrel to move the pins to the next slots 40*c*, 40*a* to transition the tool into the RIH position.

The mandrel is then pulled upwards again relative to the actuation housing to place the pins in the next slots 52*b*, 52*a*, to transition the tool into the S-SET position, wherein the shifting slips are expanded (224). The upward force is increased until it is sufficient to move the entire tool upwards (226).

When the shifting dogs reach the next frac sleeve profile, the tool is initially restricted from moving upwards by the shear pin of the frac sleeve even with an increasing upward force exerted thereon 228. However, once the magnitude of the upward force 230 reaches the shear pin threshold of the frac sleeve, the shear pin breaks and the frac sleeve shifts open, and the process repeats as described above.

In addition to the sample illustrated configuration of the tool, it is possible to use the same or a similar dual direction J-slot mechanism with a single J-slot profile to operate a tool having a packer near its lower end and shifting slips near its upper end, to provide a set up packer—shift down tool. Alternatively, the tool may have a packer near each end thereof, both the upper packer and lower packer being actuable by the dual direction J-slot mechanism, to provide a packer tool that can be set by setting down or pulling up. Further, instead of packers, the tool may have dog setting devices near each end thereof, both the upper dog setting device and lower dog setting device being actuable by the dual direction J-slot mechanism. This configuration may be useful in sequentially opening and closing valves. Alternatively, instead of casing slips or shifting slips, slips designed to mechanically locate the depth of the well by giving an over pull response when pulling or pushing the tool through a casing collar or locating profile may be used with the tool and be actuable by the dual direction J-slot mechanism. In another embodiment, the uphole and/or downhole device may comprise a valve that can be opened and/or closed, and actuable by the dual direction J-slot mechanism. Of course, other types of devices can also be used with and activated by the dual direction J-slot mechanism described herein.

FIGS. 7D and 10A to 10D illustrate the operation of a tool 320 having an upper dog setting device 330*a* (instead of a packer) and a lower dog setting device 330*b* at or near its uphole end and downhole end, respectively. Instead of casing slips, the tool has uphole shifting slips 364*a* and downhole shifting slips 364*b*. Accordingly, the upper and lower dog setting devices 330*a*, 330*b* are for engaging and setting shifting slips 364*a*, 364*b*, respectively.

In this embodiment, the lower dog setting device 330*b* and corresponding shifting slips 364*b* have the same features and function the same way as dog setting device 30 and shifting slips 64, respectively, as described above with respect to tool 20. Further, the upper dog setting device 330*a* and corresponding shifting slips 364*a* have the same features and function the same way as the lower dog setting device 330*b* and shifting slips 364*b*, respectively, except that they are positioned at or near the uphole end of the tool 320, instead of the downhole end. All other components of tool 320 are the same as those with respect to tool 20 described above. Further, tool 320 uses the same J-slot mechanism as described above, a sample rolled-out J-slot profile of which is shown in FIG. 7D.

Figure 10A:
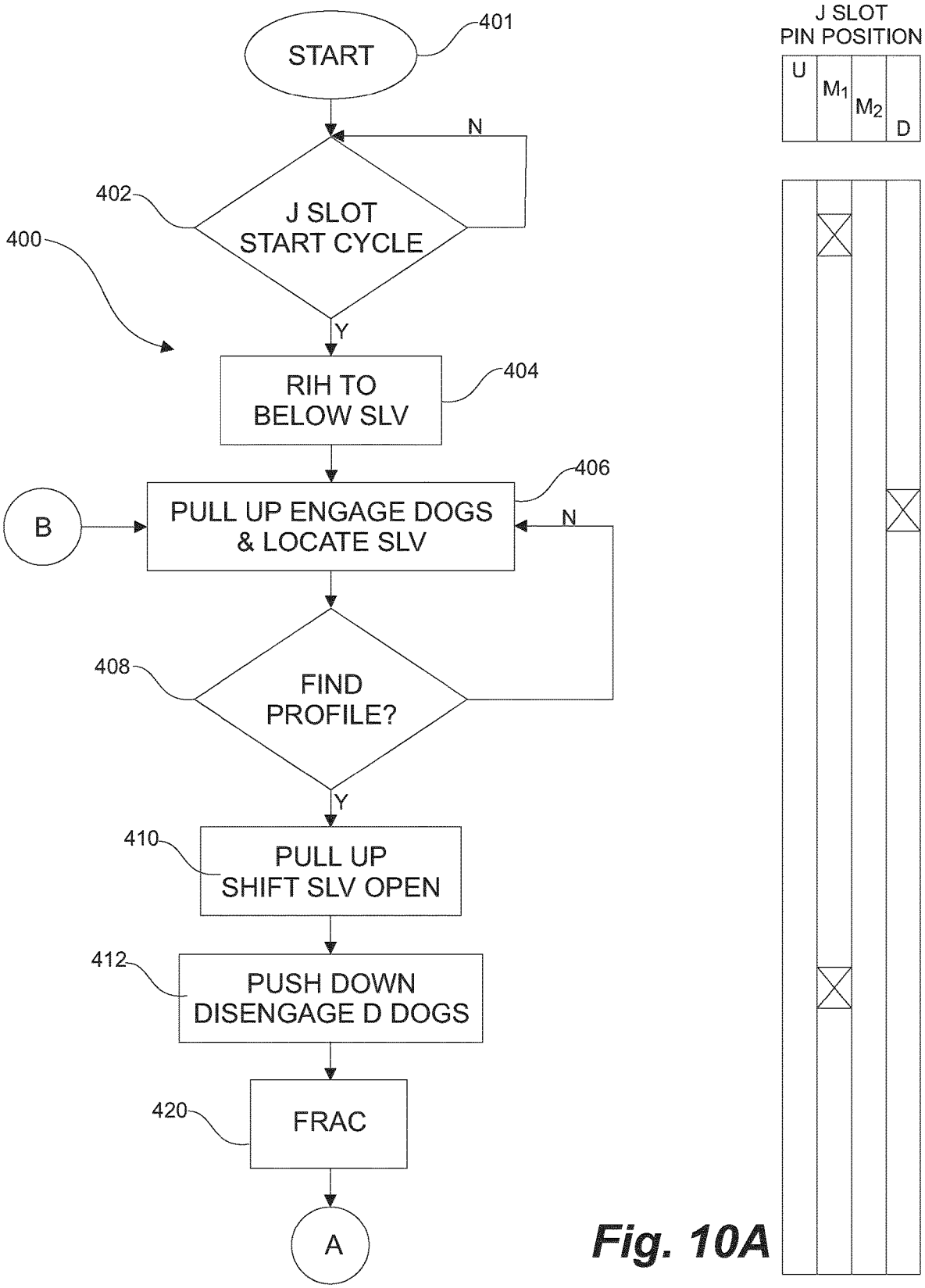
FIGS. 10A and 10B are a flowchart illustrating the sequence of events and the corresponding pin location in the J-slot profile when another dual direction J-slot tool is in operation, according to another sample embodiment.
Figure 10B:
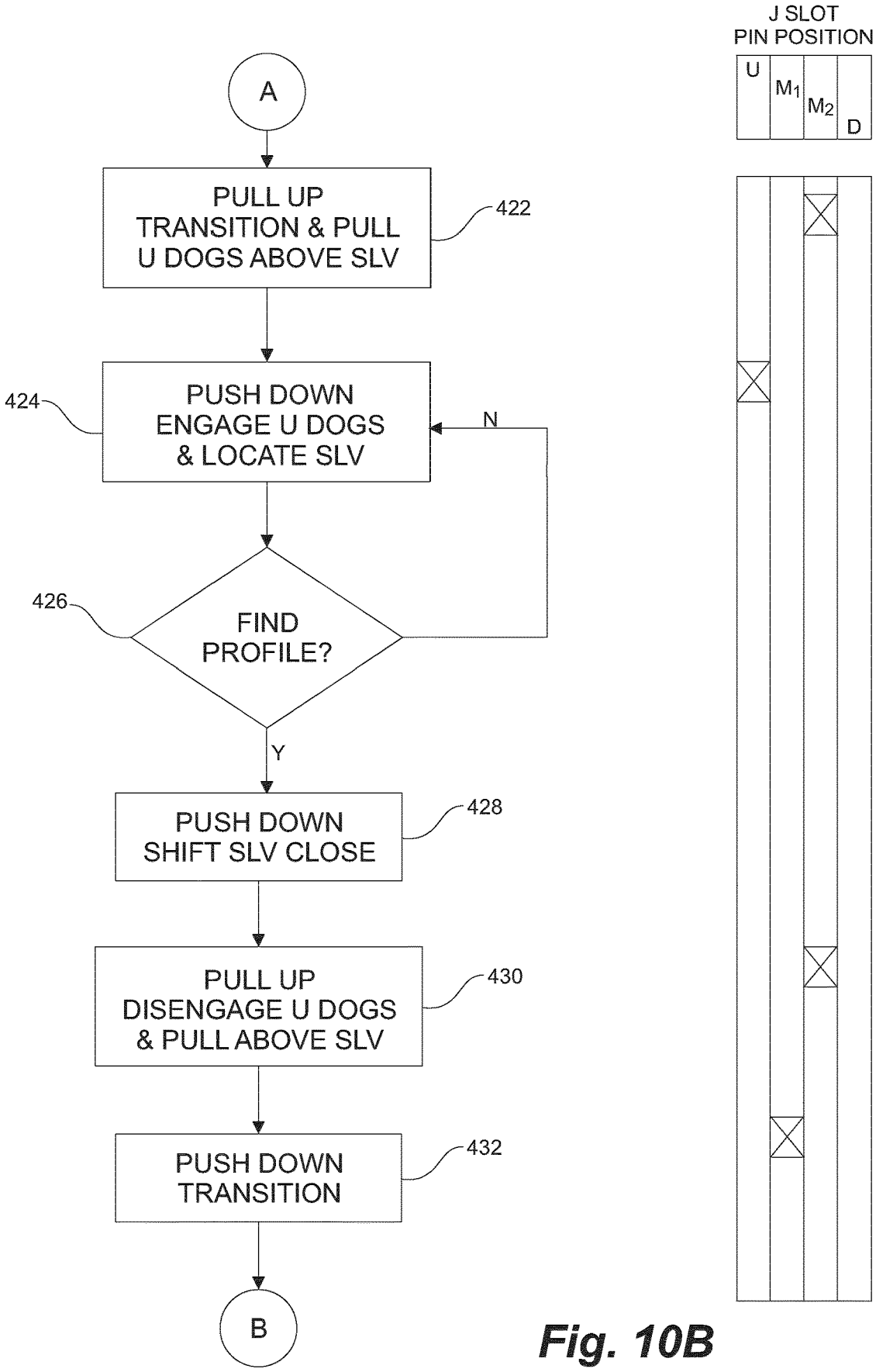
Figure 10C:
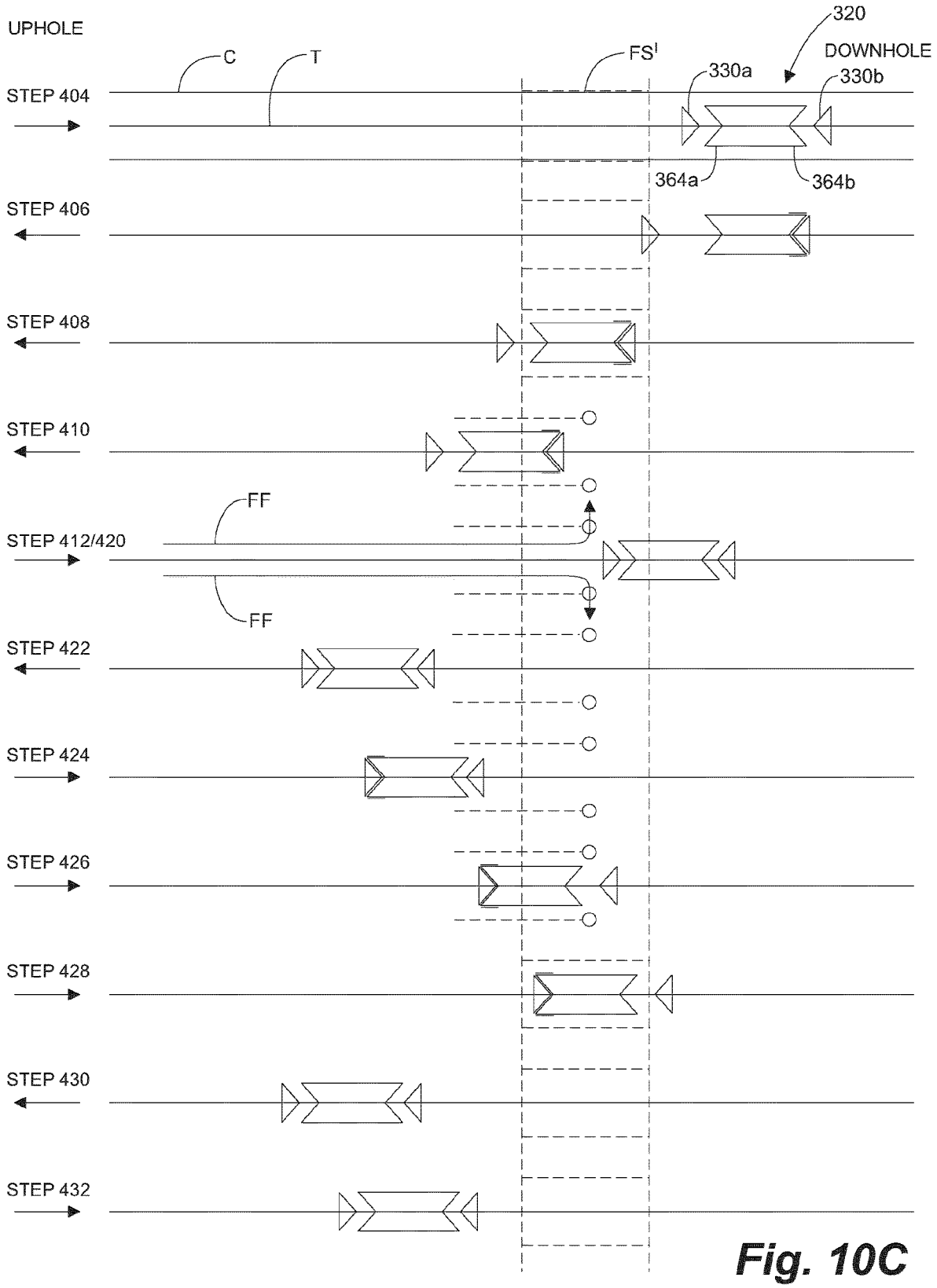
FIG. 10C is a schematic view showing the various positions of the dual direction J-slot tool of FIGS. 10A and 10B relative to a downhole frac sleeve when the tool is in operation.

With reference to FIGS. 7D, 10A and 10C, the process 400 for operating the tool 320 begins at step 401. Prior to run in, the tool is coupled to the conveyance string T and is checked (step 402) to ensure that it is in a start cycle RIH position (i.e. the pins are in the M1 position of the RIH slots 40*a* and 40*c*). If the tool is not in the start cycle RIH position, the pins are cycled through the J-slot profile by pushing and pulling on the mandrel until they are in the RIH slots 40*a*, 40*c*. If the tool is in the start cycle RIH position, the tool is run into the wellbore to a location below a frac sleeve FS' to be shifted open by the tool, e.g. the lowermost frac sleeve (step 404). In order to move the tool downhole, the forces exerted on to the mandrel are sufficient to overcome the frictional forces between the drag blocks and the inner surface of the casing C.

In this embodiment, the frac sleeves FS' in the casing can be opened and closed by the tool 320. For example, each frac sleeve has two profiles: one for opening the frac sleeve ("open profile") and one for closing the frac sleeve ("close profile"). In this embodiment, the open profile is at or near the downhole end of the sleeve and the close profile is at or near the uphole end of the sleeve.

The pins are secured in the M1 position of slots 40*a*, 40*c* as the entire tool is being run in. Once the tool is below the frac sleeve, the mandrel is pulled up. As the mandrel is being pulled upwards, the pins slide along the RIH slots 40*a*, 40*c* and into the S-SET slots 52*a*, 52*b* via transition galleries 44, thereby placing the pins in the D position and accordingly placing the tool in the S-SET position (step 406) wherein the downhole shifting slips 364*b* are expanded.

After the downhole shifting slips 364*b* are expanded, the upward force on the mandrel is increased to move the entire tool upwards in order to locate the open profile of the frac sleeve. The frac sleeve may, for example, include a first shear pin operable with the open profile and the first shear pin has a breaking threshold of about 8,000 lbs. Therefore, to locate the open profile, the tool is pulled upwards until a pulling force that is near but less than the first shear pin threshold is reached (step 408).

Once the open profile is located, additional pulling force is exerted on the mandrel to break the first shear pin to open the frac sleeve (step 410). After the frac sleeve is opened, a downward force is exerted on the tool to move the mandrel downwards relative to the actuating housing. As the mandrel moves downwards, the pins slide along the S-SET slots 52*a*, 52*b* and into the adjacent RIH slots 40*b*, 40*d*, respectively, thereby retracting the downhole shifting slips 364*b* by disengaging the lower dog setting device 330*b* therefrom and then transitioning the tool into the RIH position (step 412). At step 412, the pins are in the M1 position. The downward force is then increased to push the entire tool downhole until the tool 320 is below the opened frac sleeve (step 412). Treatment fluid FF is then pumped down the tubing string and/or the casing annular space and exits through the opened frac sleeve into the formation (step 420).

After the desired amount of treatment fluid has been pumped into the formation, the mandrel is pulled up relative to the actuation housing to move the pins along the RIH slots 40*b*, 40*d* and into POOH slots 50*a*, 50*c*, to transition the tool into the POOH position (step 422). At step 422, the pins are in the M2 position. The pulling force on the mandrel is then increased to pull the tool up until it is above the opened frac sleeve (step 422).

To set the uphole shifting slips 364*a*, the mandrel is pushed down relative to the actuation housing to move the pins from the POOH slots 50*a*, 50*c* to the P-SET slots 42*a*, 42*b* into the U position. In this embodiment, rather than setting a packer, the upper dog setting device 330*a* engages the uphole shifting slips 364*a* when the tool 320 is in the U position (step 424). The pushing force on the mandrel is increased to move the entire tool downwards in order to locate the close profile of the frac sleeve. The frac sleeve may, for example, include a second shear pin (or a detent) operable with the close profile and the second shear pin has a breaking threshold of about 8,000 lbs. Therefore, to locate the close profile, the tool is pushed downwards until a pushing force that is near but less than the second shear pin threshold is reached (step 426).

Once the close profile of the frac sleeve is located, additional pushing force is exerted on the mandrel to break the second shear pin (or overcome the detent) to close the frac sleeve (step 428). After the frac sleeve is closed, an upward force is exerted on the tool to move the mandrel upwards relative to the actuating housing. As the mandrel moves upwards, the pins slide along the P-SET slots 42*a*, 42*b* and into the adjacent POOH slots 50*b*, 50*d*, respectively, thereby retracting the uphole shifting slips 364*a* by disengaging the upper dog setting device 330*a* therefrom and then transitioning the tool into the POOH position (step 430). At step 430, the pins are in the M2 position.

Before moving the tool 320 to the next frac sleeve to be opened, the mandrel is pushed down relative to the actuation housing in order to transition the tool from the POOH position into the RIH position, wherein the pins are in the M1 position (step 432). The mandrel is then pulled up relative to the actuation housing to move the pins from the M1 position to the D position, thereby placing the tool in the S-SET position (step 406). The upward force on the mandrel is then increased to move the entire tool upwards to locate the open profile of the next frac sleeve to be opened and the above described steps 408, 410, 412, 418, 420, 422, 424, 426, 428, 430 and 432 are repeated, respectively, as described above, until the formation is fracked as desired.

Since the frac sleeves in above-described embodiment have profiles in both the uphole and downhole directions, they are openable and recloseable. Preferably, one frac valve is opened, treatment is completed through that frac valve, and then the frac valve is closed. In the meantime, the valves above and below that one frac valve are closed. In this manner, only one open frac valve is treated at any given time. After treatment is completed via one frac valve, the frac valve is closed and another valve can be opened and treated. In this embodiment, it is not necessary to seal the casing below the opened frac valve using a separate packer or the like.

Figure 10D:
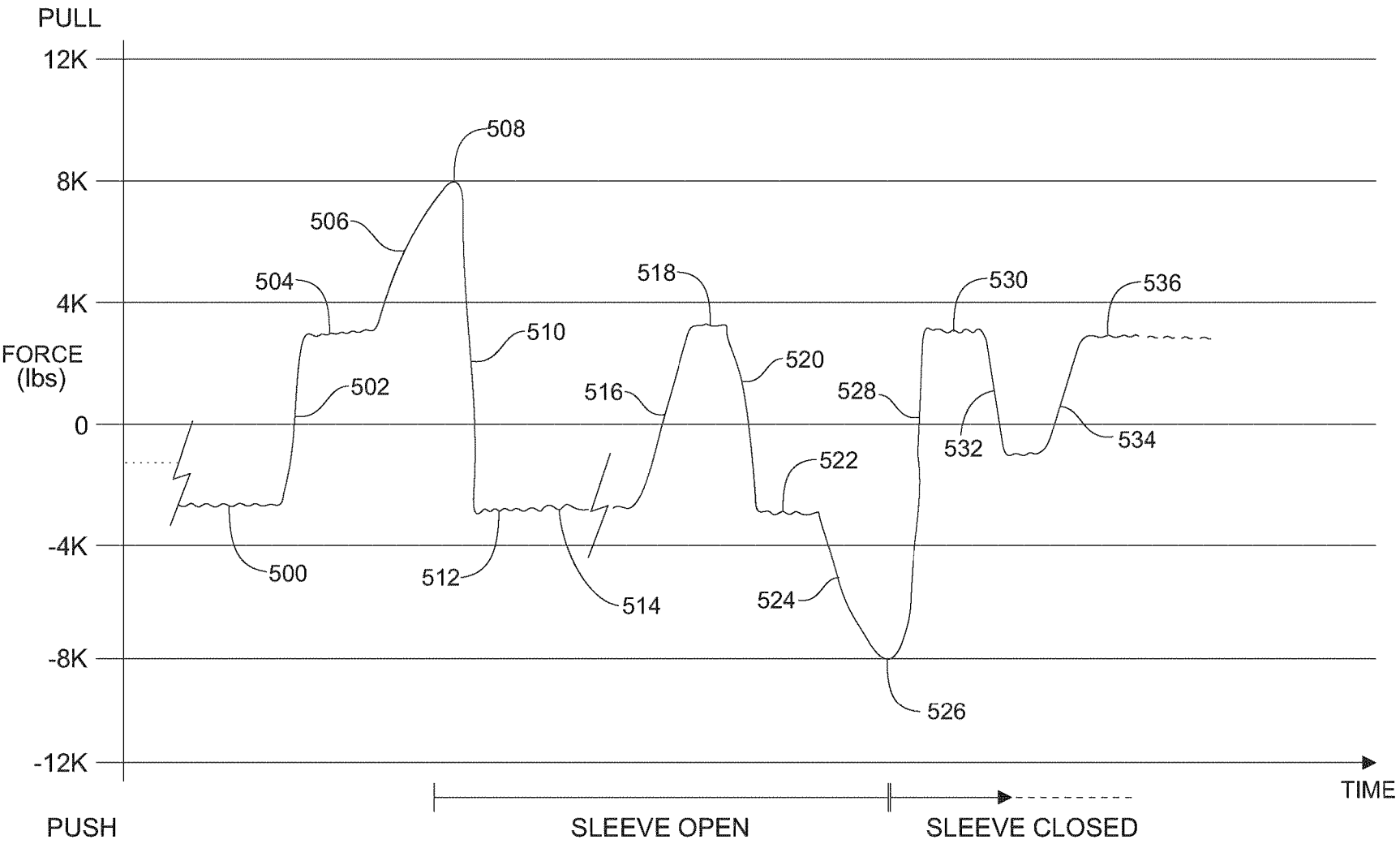
FIG. 10D is a graph illustrating the forces on the mandrel according to a sample embodiment, when the dual direction J-slot tool of FIGS. 10A and 10B is in operation.

FIG. 10D is a graph showing the sample forces on the mandrel throughout the operation of the tool 320. The magnitudes shown are examples only. In reality, the tool may experience different magnitudes of forces. At the start, the tool 320 is in the RIH position where the pins are in the RIH slots 40*a*, 40*c* and it is run into the wellbore by a downward force 500 that is sufficient to overcome the frictional forces between the drag blocks and the casing. When the tool reaches below the frac sleeve to be opened, an upward force 502 is exerted on the mandrel that is sufficient to move the mandrel upwards relative to the actuation housing. The tool is thereby transitioned to the S-SET position wherein the downhole shifting slips 364*b* are expanded. The upward force is then increased to move the entire tool upwards (504).

When the downhole shifting slips 364*b* encounter the open profile of the frac sleeve, the tool is initially restricted from moving upwards, such as by the first shear pin, even with an increasing upward force 506 exerted thereon. However, once the magnitude of the upward force 508 reaches the first shear pin threshold of the frac sleeve (e.g. 8,000 lbs), the first shear pin breaks and the frac sleeve shifts open. Once the sleeve is opened, the force on the mandrel is switched to a downward force 510 to move the pins to the next slots 40*b*, 40*d*, thereby transitioning the tool to the RIH position. The downward force 512 is then increased to move the entire tool downwards until it is below the opened frac sleeve.

Once the tool is below the opened frac sleeve, treatment fluid is pumped down the tubing string and/or the casing annular space to treat the formation via the opened frac sleeve. While the formation is being treated, the downward force 514 on the mandrel may be reduced.

After the treatment is completed through the opened frac sleeve, an upward force 516 is exerted on the mandrel to move the mandrel upwards relative to the actuation housing to move the pins to the next slots 50*a*, 50*c*, thereby transitioning the tool 320 to the POOH position. The upward force 518 is increased to move the tool 320 above the opened frac sleeve. A downward force 520 is then exerted on the mandrel to move the pins to the next slots 42*a*, 42*b*, thereby transitioning the tool to the P-SET position wherein the uphole shifting slips 364*a* are expanded. The downward force 522 is increased to move the tool 320 downhole to locate the close profile of the opened frac sleeve.

When the downhole shifting slips 364*b* encounter the close profile, the tool is initially restricted from moving downwards, such as by the second shear pin (or detent), even with an increasing downward force 524 exerted thereon. However, once the magnitude of the downward force 526 reaches the second shear pin (or detent) threshold of the frac sleeve (e.g. 8,000 lbs), the second shear pin breaks (or the detent releases) and the frac sleeve closes.

Once the frac sleeve is closed, an upward force 528 is exerted on the mandrel to shift the pins out of the P-SET slots 42*a*, 42*b*, to retract the uphole shifting slips 364*a*. As the mandrel is continued to be pulled upwards relative to the actuation housing, the pins are moved to the next slots 50*b*, 50*d*, thereby transitioning the tool into the POOH position. The upward force 530 is increased to move the entire tool 320 above the closed frac sleeve. A downward force 532 is then exerted on the mandrel to move the pins to the next slots 40*c*, 40*a* to transition the tool into the RIH position.

From the RIH position, an upward force 534 is exerted on the mandrel to move it uphole relative to the actuation housing to place the pins in the next slots 52*b*, 52*a*, thereby transitioning the tool to the S-SET position, wherein the downhole shifting slips 364*b* are expanded. The upward force 536 is increased until it is sufficient to move the entire tool 320 upwards towards the next frac sleeve to be opened. Once the tool reaches the open profile of the next frac sleeve, the process repeats as described above.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A multi-position tool at a downhole end of a conveyance string for operation in a casing string, the tool comprising:

a mandrel having an uphole end and a down hole end, the uphole end of the mandrel being connected to the conveyance string;

an actuation housing slidably shiftable axially along the mandrel between an uphole position, at least one intermediate position and a downhole position;

an uphole device, positioned between the uphole end of the mandrel and the at least one intermediate position, operable between an activated position when the actuation housing is in the uphole position, and a deactivated position; and a downhole device, positioned between the downhole end of the mandrel and the at least one intermediate position, operable between an activated position when the actuation housing is in the downhole position, and a deactivated position, wherein both the uphole and downhole devices are in their deactivated positions when the actuation housing is in the at least one intermediate position; and a J-slot mechanism operable between the actuation housing and the mandrel for shifting the actuation housing between the uphole, at least one intermediate, and downhole positions.

2. The tool of claim 1 wherein the J-slot mechanism comprises a single continuous J-slot profile.

3. The tool of claim 2 wherein the single continuous J-slot profile has a span of 360 degrees.

4. The tool of claim 3 wherein the wherein the single continuous J-slot profile includes at least one RIH slot, at least one P-SET slot, at least one POOH slot, and at least one S-SET slot arranged in a pattern, and wherein the pattern is repeated more than once in the 360 degree span.

5. The tool of claim 2 wherein the uphole device is a resealable packer assembly comprising a packer element; and wherein the actuation housing comprises a pin and shifting slips fitted to a downhole end of the actuation housing; wherein the single continuous J-slot profile is configured to receive the pin of the actuation housing and includes at least one RIH slot, at least one P-SET slot, at least one POOH slot, and at least one S-SET slot; the P-SET slot being configured to receive the pin when the pin moves to activate the packer element and the S-SET being configured to receive the pin when the pin moves to activate the shifting slips; and wherein the distal end of the P-SET slot is closer to the uphole end of the mandrel than is the distal end of the RIH slot; and wherein the distal end of the S-SET slot is closer to the downhole end of the mandrel than is the distal end of the POOH slot.

6. The tool of claim 5 wherein the J-slot profile includes two S-SET slots and two P-SET slots, and wherein the two P-SET slots are separated from one another on the mandrel by about 180°, and the two S-SET slots are separated from one another on the mandrel by about 180°.

7. The tool of claim 5 wherein the J-slot profile includes two S-SET slots and two P-SET slots, and wherein in the span between an S-SET slot and a P-SET slot, the J-slot profile includes at least one RIH slot and at least one POOH slot.

8. The tool of claim 7 wherein in the span between the two S-SET slots and in the span between the two P-SET slots, the J-slot profile includes at least two POOH slots and at least two RIH slots.

9. The tool of claim 1 further comprising an uphole ring fixed to the mandrel and casing slips fitted to an uphole end of the actuation housing, wherein the uphole device is a resealable packer assembly comprising an actuation cone and a packer element between the uphole ring and the actuation cone, and upon a downhole movement of the mandrel, the actuation housing shifts to the uphole position, the casing slips engage the actuation cone and the casing slips and packer element operate to the activated position.

10. The tool of claim 9 wherein upon an uphole movement of the mandrel, the actuation housing shifts downhole to the intermediate position, the casing slips disengage from the actuation cone and the casing slips and packer element operate to the deactivated position.

11. The tool of claim 1 wherein one or both of the uphole and downhole devices is a valve that is opened in the activated position and closed in the deactivated position, or is closed in the activated position and opened in the deactivated position.

12. A multi-position tool at a downhole end of a conveyance string for operation in a casing string, the tool comprising:

a mandrel having an uphole end and a downhole end, the uphole end of the mandrel being connected to the conveyance string;

an actuation housing slidably shiftable axially along the mandrel between an uphole position, least one intermediate position and a downhole position;

an uphole device operable between an activated position when the actuation housing is in the uphole position, and a deactivated position; and a downhole device operable between an activated position when the actuation housing is in the downhole position, and a deactivated position, wherein both the uphole and downhole devices are in their deactivated positions when the actuation housing is in the at least one intermediate position; and a J-slot mechanism operable between the actuation housing and the mandrel for shifting the actuation housing between the uphole, at least one intermediate, and downhole positions;

a downhole ring fixed to the mandrel and shifting slips fitted to a downhole end of the actuation housing, wherein the downhole device is a dog setting device comprising an actuation cone, and upon an uphole movement of the mandrel, the actuation housing shifts downhole to the downhole position, the shifting slips engage the actuation cone and the shifting slips operate to the activated position.

13. The tool of claim 12 wherein upon a downhole movement of the mandrel, the actuation housing shifts uphole to the intermediate position, the shifting slips disengage from the actuation cone and the shifting slips operate to the deactivated position.

14. The tool of claim 12 wherein the shifting slips in the activated position are receivable in a profile of a frac sleeve and when the shifting slips are received in the profile, the frac sleeve is openable by an upward force on the mandrel above a predetermined threshold.

15. A multi-position tool at a downhole end of a conveyance string for operation in a easing stung, the tool comprising:

a mandrel having an uphole end and a down hole end, the uphole end of the mandrel being connected to the conveyance string;

an actuation housing slidably shiftable axially along the mandrel between an uphole position, at least one intermediate position and a downhole position;

an uphole device operable between an activated position when the actuation housing is in the uphole position, and a deactivated position; and a downhole device operable between an activated position when the actuation housing is in the downhole position, and a deactivated position, wherein both the uphole and downhole devices are in their deactivated positions when the actuation housing is in the at least one intermediate position;

a J-slot mechanism comprising a single continuous J-slot profile and being operable between the actuation housing and the mandrel for shifting the actuation housing between the uphole, at least one intermediate, and downhole positions, an uphole ring fixed to the mandrel at a first location and a downhole ring fixed to the mandrel at a second location that is downhole relative to the first position; and wherein the uphole device includes a first cone and the downhole device includes a second cone; and wherein the actuation housing includes first slips fitted to its uphole end that are configured to releasably engage the first cone, and second slips fitted to its downhole end that are configured to releasably engage the second cone;

the tool configured such that, upon a downhole movement of the mandrel, the actuation housing shifts to the uphole position and the first slips engage the first cone and upon an uphole movement of the mandrel, the actuation housing shifts to the downhole position and the second slips engage the second cone.

16. The tool of claim 15 wherein each of the uphole device and the downhole device is a dog setting device.

17. The tool of claim 15 wherein each of the uphole device and the downhole device is selected from the group consisting of a packer, a dog setting device, and a valve; and wherein the downhole device is a different one of the group than the uphole device.

18. A method of operating a tool connected to a conveyance string that is disposed within a casing string, wherein the tool includes a mandrel, a packer, an actuation housing including shifting slips, the actuation housing being axially slidable along the mandrel, a J-slot mechanism operable between the actuation housing and the mandrel for shifting the actuation housing between multiple positions, the J-slot mechanism having pins and a J-slot profile that includes at least one RIH slot, at least one P-SET slot, at least one POOH slot, and at least one S-SET slot, the P-SET slot being configured to receive the pins when the pins move to activate the packer and the S-SET being configured to receive the pins when the pins move to activate the shilling slips the method comprising:

positioning the pins of the J-slot mechanism within the RIH slots;

moving the tool below a first frac sleeve that is to be shifted open;

moving the pins into the S-SET slots while pulling the mandrel up;

opening the first frac sleeve by increasing the upward force on the mandrel and moving the tool upwards;

moving the pins from the S-SET slots into RIH slots adjacent to the S-SET slots by applying a downward force on the tool and moving the mandrel downwards relative to the actuation housing;

increasing the downward force and pushing the tool further downhole until the packer is below the frac sleeve;

moving the pins into POOH slots while pulling the mandrel up relative to the actuation housing;

moving the pins from the POOH slots to the P-SET slots while pushing the mandrel down relative to the actuation housing.

19. The method of claim 18 further comprising:

after conveying a desired amount of treatment fluid through the first frac sleeve;

moving the pins from the P-SET slots into adjacent POOH slots by pulling up on the mandrel relative to the actuation housing.

20. The method of claim 19 further comprising:

moving the pins from the POOH slots into adjacent RIH slots by pushing the mandrel down relative to the actuation housing;

moving the pins to the S-SET slots by pulling the mandrel up relative to the actuation housing;

increasing the upward force on the mandrel and moving the tool upwards toward a second frac sleeve to be shifted open.

* * * * *